US007508370B2

(12) United States Patent
Sekiguchi et al.

(10) Patent No.: US 7,508,370 B2
(45) Date of Patent: Mar. 24, 2009

(54) LIQUID-CRYSTAL DISPLAY DEVICE AND METHOD OF DRIVING LIQUID-CRYSTAL DISPLAY DEVICE

(75) Inventors: Yoshifumi Sekiguchi, Hitachiota (JP); Shoichi Hirota, Hitachi (JP); Shinichi Komura, Hitachi (JP)

(73) Assignee: Hitachi Displays, Ltd., Chiba (JP)

( * ) Notice: Subject to any disclaimer, the term of this patent is extended or adjusted under 35 U.S.C. 154(b) by 863 days.

(21) Appl. No.: 11/150,793

(22) Filed: Jun. 9, 2005

(65) Prior Publication Data

US 2006/0007092 A1 Jan. 12, 2006

(30) Foreign Application Priority Data

Jun. 16, 2004 (JP) ..... 2004-178090

(51) Int. Cl.
*G09G 3/34* (2006.01)
*G09G 3/36* (2006.01)

(52) U.S. Cl. ..... 345/99; 345/87; 345/89; 345/93; 345/94; 345/95; 345/96

(58) Field of Classification Search ..... 345/87–104
See application file for complete search history.

(56) References Cited

U.S. PATENT DOCUMENTS 5,712,652 A * 1/1998 Sato et al. ..... 345/90
6,667,732 B1 * 12/2003 Katase ..... 345/103
2002/0180673 A1 12/2002 Tsuda et al.

FOREIGN PATENT DOCUMENTS

JP 2001-356746 12/2001
JP 2002-182619 6/2002

OTHER PUBLICATIONS

U.S. Appl. No. 10/729,391, filed Dec. 5, 2003, Sekiguchi et al.

* cited by examiner

*Primary Examiner*—Sumati Lefkowitz
*Assistant Examiner*—Alexander S. Beck
(74) *Attorney, Agent, or Firm*—Hogan & Hartson LLP

(57) ABSTRACT

An active matrix type liquid crystal display device driving method for switching a partial display mode and a normal display mode. The respective data lines of the partial display area are scanned in a certain period defined as a frame period, "k" pieces (symbol "k" is integer larger than, or equal to 1) of the partial display areas are present within 1 screen, a common electrode potential is varied 2k times within 1 frame period; a common electrode potential in a partially scanning period for scanning the partial display area is made as a constant potential against a reference of a driving circuit for driving the data lines; and within at least two continued frames, a common electrode potential of a blank period other than the partially scanning period is made as a constant potential which is different from the constant potential in the partially scanning period.

24 Claims, 11 Drawing Sheets

LIQUID-CRYSTAL DISPLAY DEVICE AND METHOD OF DRIVING LIQUID-CRYSTAL DISPLAY DEVICE

CROSS-REFERENCE TO RELATED APPLICATION

The present invention is related to (1) U.S. patent application Ser. No. 10/729,391 entitled "Liquid-Crystal Display Device and Method of Driving Liquid-Crystal Display Device" filed on Dec. 5, 2003. The disclosures of the above U.S. application is herein incorporated by reference.

BACKGROUND OF THE INVENTION

The present invention generally relates to a display apparatus of a mobile appliance such as cellular telephones. More specifically, the present invention is directed to a liquid crystal display device capable of realizing a high picture quality and operable in low power consumption.

As a driving method for making a display on a so-called "partial display area" of a display panel and also for making a partial display on other display areas of this display panel, in which the background is displayed, the below-mentioned driving method has been disclosed in, for example, JP-A-2001-356746. That is, while a display device is equipped with a plurality of pixels formed in a matrix of "n" rows and "m" columns, the display device performs a so-called "partial display" operation in a partial screen area which is constituted by arbitrarily selected pixels made of "s" rows and "m" columns, and also displays the background on a background screen area made of the above-described "n" rows and "m" columns. In the driving method for the above-described display device, when a partial display mode is selected, the above-explained partial display data is written in the respective pixels of the partial screen area constituted by the above-described "s" rows and "m" columns, and also, background display data are written in pixels made of "k" rows and "m" columns within the background display area during 1 frame period. It should be understood that all of symbols "n", "m", "s", and "k" represent integers larger than, or equal to 1, and further, mutual relationships are given by s<n, and k<n.

Also, JP-A-2002-182619 discloses the below-mentioned method of driving the display device. That is, in this driving method, while a break period is provided in any periods other than a scanning period, since an effective voltage applied to a liquid crystal layer is made equal to an effective voltage within this break period, the flickering may be suppressed and power consumption may be lowered.

The above-described patent publication of JP-A-2001-356746 does not describe a driving method capable of suppressing deteriorations in picture qualities, and more specifically, capable of suppressing the flickering. Also, the above-explained patent publication of JP-A-2002-182619 does not describe a driving method for performing a partial display operation.

Referring now to FIG. 10A through FIG. 12, problems to be solved by the present invention will be described.

In a liquid crystal display device of a cellular telephone operated in a standby mode, only limited contents of such information as an antenna sensitivity and a battery level may be sometimes displayed on a portion of a liquid crystal display panel of the liquid crystal display apparatus (namely, partial display operation).

FIG. 10A is a schematic block diagram of a liquid crystal display device 1 which performs such a display operation shown in FIG. 10B. FIG. 10B to FIG. 10E represent display examples as to display conditions in a liquid crystal display panel having pixels which are constructed of "N" rows and "M" columns in a matrix form. It should be noted that symbols "N" and "M" indicate integers larger than, or equal to 1.

The liquid crystal display device 1 contains a liquid crystal panel 2, a source driver 3, a gate driver 4, and a power supply circuit 5. These circuits may be provided in separate LSIs, a portion of these circuits may be alternatively provided in partially commonly used LSIs, or all of these circuits may be alternatively provided in a commonly used LSI. Also, either a portion or all of these circuits may be alternatively built in a liquid crystal panel. In this specification, the below-mentioned explanations will be made in such a case that these circuits are provided in the separate LSIs.

In the liquid crystal panel 2, an area where a partial display operation is carried out will be referred to as a "partial display area", whereas an area other than the partial display area will be referred to as a "background display area." Such an operation that a partial display is performed will be referred as a "partial display mode."

Under a display condition of FIG. 10B, while a partial display is performed by employing a gate line of a first row up to a gate line of an "(i0)-th" row, a certain potential corresponding to the background has been held, or applied to such pixels which are connected from a gate line of an (i0+1)-th row up to a gate line of an N-th row; and thus, the background has been displayed. When the background display area is scanned, voltages which are applied to the liquid crystal of the background display area are equal to each other at the most pixels of the background display area, and the background display area displays the substantially same color and the substantially same luminance.

In the case of FIG. 10C, in a foldable type cellular telephone, two liquid crystal panels are provided which are constituted by a main panel 2' and a sub-panel 2". Various sorts of setting operations as to the cellular telephone are performed on the main panel 2'. Information is displayed on the sub-panel 2" even under folded condition. A data line is commonly used for both the main panel 2' and the sub-panel 2".

The condition of FIG. 10C corresponds to such a case that the cellular telephone has been folded, and the entire screen of the main panel 2' corresponds to the background display area. The partial display area corresponds to such areas defined from an (i1)-th row to an (i2)-th row of the sub-panel 2", and the background display area corresponds to such an area defined by the remaining rows of the sub-panel 2".

In the case of FIG. 10D, an (i3)-th row to an (i4)-th row of the main panel 2 correspond to the partial display area, whereas the remaining rows of the main panel 2 correspond to the background display area.

In the case of FIG. 10E, two partial display areas are present which are defined from a first row up to an (i5)-th row of the main panel 2, and from an (i6)-th row up to an (i7)-th row of the main panel 2. A background display area is defined by the remaining rows of the main panel 2. It should be understood that in FIG. 10A to FIG. 10E, symbols "i0", "i1", --- , "i6", and "i7" indicate integers larger than, or equal to 2.

In the below-mentioned descriptions, the display mode of the liquid crystal panel 2 is assumed to as a "normally open." First of all, operations of the normal case in which the entire screen of the liquid crystal panel 2 is displayed are summarized. This normal case will be referred to as a "normal display mode" hereinafter, and a time period during which a gate line is scanned. Also, in such a case that a cellular telephone owns two display screens and a data line is commonly used in both a main panel 2' and a sub-panel 2", when information is displayed on the main panel 2', the display mode of the liquid crystal panel 2 corresponds to the normal display mode. In this case, such a time period during which the gate line of the main panel 2' is scanned will be referred to as a frame period, whereas a time period during which one row is scanned in the gate lines of the main panel 2' will be referred to as a period "Thn" for scanning one row.

FIG. 11A indicates an equivalent circuit diagram as to 1 pixel defined by an "n" row, and an "m" column. FIG. 11B represents a driving method diagram as to a data line potential "$V_{dm}$", a common electrode potential "$V_{com}$", and gate line potentials "$V_{g1}$" to "$V_{gN}$"; and shows an absolute value "$V_{alc}$" (will be simply referred to as "voltage $V_{alc}$" hereinafter) between a pixel electrode potential "$V_{pix}$" and the common electrode potential "$V_{com}$" of the pixel defined by the "n" row and the "m" column; and also indicates an optical response of the pixel defined by the "n" row/"m" column.

The source driver 3 produces a grayscale voltage while the ground potential 0 V is used as a reference potential. Both the data line potential $V_{dm}$ and the common electrode potential $V_{com}$ have been drawn while this potential is used as a reference potential. In the below-mentioned explanations, references (0 V) of the respective potentials are defined as the ground potential. It should also be understood that in the respective drawings except for FIG. 5, the gate line potentials $V_{g1}$ to $V_{gN}$ are illustrated as simplified pulses, while an attention has been paid only to timing, but are not illustrated while the ground potential is employed as the reference potential.

The equivalent circuit shown in FIG. 11A is explained. In this equivalent circuit, an active element functioning as a switch is present at an intersection portion between a data line (signal line) 101 and a gate line (scanning line) 102, and this active element is made of a thin-film transistor (will be referred to as "TFT" hereinafter) in this example.

While the gate line 102 controls turning ON/OFF of the TFT, when the gate line potential "$V_{gn}$" of the n-th row becomes "high" (high potential becomes approximately 10 V to 15 V), the TFT is under ON state, and the circuit between the data line 101 and the pixel electrode becomes conductive, so that the data line potential $V_{dm}$ of the m-th column is applied to the pixel electrode.

When the gate line potential $V_{gn}$ of the n-th row becomes "low" (low potential becomes approximately 0 V to −15 V), the TFT is under OFF state. A line between the data line 101 and the pixel electrode is brought into a high resistance condition, and thus, an electron charge of the pixel is held. The TFT under OFF state may be expressed as a resistor "$R_{off}$" which is connected to the data line 101 and the pixel electrode.

While liquid crystal is represented by a parallel circuit constructed of a liquid crystal capacitor "$C_{1c}$" and a liquid crystal resistor "$R_{1c}$", a voltage between the pixel electrode and the common electrode 100 is applied to the liquid crystal. A storage capacitor "$C_{stg}$" for holding an electron charge is arranged between a storage line 103 and the pixel electrode. A parasitic capacitor "$C_{sd1}$" is present between the pixel electrode and the data line 101 which is connected to the TFT of the pixel, and another parasitic capacitor "$C_{sd2}$" is present between the pixel electrode and a data line which is located opposite to the data line 101 connected to the TFT of the pixel while sandwiching the pixel electrode of the pixel. Also, another parasitic capacitor "$C_{gs}$" is present between the pixel electrode and the gate line 102. Since the parasitic capacitors are present, when the potential on the data line 101 and the potential on the gate line 102 are varied, the pixel electrode potential is varied due to capacitive coupling, so that an optical response change may be caused. Also, even when the TFT is under OFF state, a leak current will flow because both the resistor "$R_{off}$" and the liquid crystal register "$R_{1c}$" are present, so that the pixel electrode potential is varied.

Next, a description is made of the driving method diagram for two continued frames shown in FIG. 11B. In a frame period "Tf", the common electrode potential $V_{com}$ becomes either a potential "$V_{comH}$" or another potential "$V_{comL}$". It is so assumed that such a frame when the common electrode potential $V_{com}$ becomes the potential $V_{comL}$ is referred to as a positive frame, and a frame when the common electrode potential $V_{com}$ becomes the potential $V_{comH}$ is referred to as a negative frame. The common electrode potential $V_{com}$ is inverted every frame. The data line potential $V_{dm}$ becomes such a potential in correspondence with a potential of image data. In this drawing, the data line potential $V_{dm}$ represents such a case that a black color is displayed on the entire screen of the liquid crystal panel. Symbols "$V_{g1}$" to "$V_{gN}$" show gate line potentials from the first row to the N-th row.

Now, a description is made of temporal changes as to the voltage $V_{alc}$. When the gate line potential $V_{gn}$ of the n-th row becomes "high", a predetermined voltage is applied. Thereafter, when the gate line potential $V_{gn}$ becomes "low", in such a case that the gate line potential $V_{gn}$ is transferred from "high" to "low", the pixel electrode potential is decreased only by "ΔVft" due to the capacitive coupling via the parasitic capacitor $C_{gs}$. It should also be noted that symbol "ΔVft" implies a magnitude of a potential drop, and will be referred to as a "feed-through voltage" hereinafter.

In the case of the negative frame, the voltage $V_{alc}$ is increased only by ΔVft, whereas in the case of the positive frame, the voltage $V_{alc}$ is decreased only by ΔVft. More specifically, this phenomenon will be called as a "feed-through" phenomenon. Since this field-through phenomenon is present, while both an amplitude center potential $V_{comc}$ of the common electrode potential "$V_{com}$" and a center potential "$V_{cen}$" of the data line potential $V_{dm}$ are made different from each other, the amplitude center potential $V_{comc}$ of the common electrode potential $V_{com}$ is made lower than the center potential $V_{cen}$ of the data line potential $V_{dm}$ by approximately ΔVft.

Since the above-explained potential setting operation is carried out, the voltages $V_{alc}$ just after the gate line potential $V_{gm}$ is changed form "high" to "low" may become equal to each other in both the positive frame and the negative frame. After the voltage $V_{alc}$ has been written, this voltage may maintain an essentially desirable voltage when the frames are switched. Since both the common electrode potential $V_{com}$ and the data line potential $V_{dm}$ are varied when the frames are switched, a voltage variation of the voltage $V_{alc}$ also occurs. Display luminance is also varied in synchronism with the variation of the voltage $V_{alc}$. In the temporal changes in the voltage $V_{alc}$, an adverse influence caused by the leak current is neglected. In such a case that a leak current is large, a voltage drop caused by this large leak current may occur. In particular, when a time period for holding the voltage $V_{alc}$ is sufficiently longer than 1/60 seconds, the adverse influence caused by the leak current cannot be neglected. Also, the optical response change as indicated in FIG. 11B may be sometimes sensed as a flicker phenomenon. If a frame frequency is lower than, or equal to 60 Hz, then a flicker phenomenon may be easily sensed. As a result, normally, a frame frequency is selected to be higher than, or equal to 60 Hz.

Next, with reference to FIG. 12, a description is made of summarized operations in the case that a partial display operation is carried out by way of the conventional driving method in the pixels defined from an (n−np)-th row up to an (n+np)-th row, which contain the pixel of the n-th row. FIG. 12 represents a timing chart of a driving method for driving two continued frames; a voltage "$V_{alc}$" of a pixel defined by an n-th row and an m-th column; and an optical response of the pixel. This timing chart of the driving method corresponds to such a case that a background display area is displayed in white and a partial display area is displayed in black.

Generally speaking, in such a case that a display mode corresponds to a normally open mode, a display operation of a background display area is set to a white display operation where a magnitude of a voltage to be applied to liquid crystal (will be referred to as "liquid crystal voltage") becomes minimum. In such a case that a display mode corresponds to a normally close mode, a display operation of a background display area is set to a black display operation. The reason is given as follows: That is, when the liquid crystal voltage is low, even if this liquid crystal voltage is varied, a deterioration of picture qualities can hardly occur. As a consequence, the background display area is not scanned every frame, but is scanned every several frames, so that a total number of scanning operations as to the background display area may be reduced so as to achieve low power consumption.

The common electrode potential $V_{com}$ behaves the same operation as that of the normal display mode. The data line potential $V_{dm}$ becomes such a potential for displaying white from a first row up to an (n−np−1)-th row; becomes such a potential for displaying black from an (n−np)-th row up to an (n+np)-th row; and again becomes such a potential for displaying white from an (n+np+1)-th row up to an N-th row.

The period during which the pixels defined from the (n−np)-th row up to the (n+np)-th row corresponding to the partial display area are scanned will be referred to as a "partially scanning period Ts." The definitions as to both the positive frame and the negative frame during the partial display mode are changed from those during the normal display mode as follows:

In the case that the black is displayed in the partially scanning period Ts, such a frame is assumed as the positive frame, in which the common electrode potential $V_{com}$ becomes lower than the data line potential $V_{dm}$. Also, in the case that the black is displayed in the partially scanning period Ts, such a frame is assumed as the positive frame, in which the common electrode potential $V_{com}$ becomes higher than the data line potential $V_{dm}$.

If both the data line potential $V_{dm}$ and the common electrode potential $V_{com}$ are varied due to the presence of the parasitic capacitor, then the voltage $V_{alc}$ is varied. In the case of the partial display mode by the conventional driving method, the variations of the voltage $V_{alc}$ may occur at least 4 times at (1) to (4) of timing shown in FIG. 12 within 1 frame period.

Similarly, changes in the optical response may occur in response to the variations of this voltage $V_{alc}$, and thus, the optical response waveform may be distorted. In such a case that the optical response waveform is distorted to become a complex waveform, it is practically difficult to form the optical response waveform as a symmetrical waveform in both the positive frame and the negative frame, and thus, the period of the optical response waveform becomes two frames. As a consequence, the flickering is produced, the frequency of which is equal to a half of the frame frequency.

In particular, since a partial display operation is mainly carried out during a standby mode of a cellular telephone, the partial display operation is required to be performed in low power consumption. To achieve such a low power consumption, there are some cases that liquid crystal display devices are driven while frame frequencies thereof are decreased lower than 60 Hz. Therefore, in the above-described conventional driving method, the flickering having frequencies lower than 30 Hz may be produced. Since the flickering having such lower frequencies may be easily sensed, image qualities of liquid crystal display devices may be considerably deteriorated.

SUMMARY OF THE INVENTION

An object of the present invention is to provide a liquid crystal display device capable of being driven in low power consumption, and a method for driving the liquid crystal display device in low power consumption, while the flickering is suppressed in a partial display mode.

In accordance with an aspect of the present invention, while a partial display mode and a normal display mode can be switched, a driving method for an active matrix type liquid crystal display device is featured by that the liquid crystal display device performs a desirable display operation on a partial display area constituted by an arbitrarily-selected number of gate lines, and displays the background on the remaining background display area when the partial display mode is selected. In the driving method, the respective gate lines of the partial display area are scanned in a certain period, and this period is set as a frame period; in such a case that "k" pieces (symbol "k" is integer larger than, or equal to 1) of the partial display areas are present in one screen, a common electrode potential is varied 2k times within 1 frame period; a common electrode potential of a partially scanning period for scanning the partial display area is made constant with respect to the ground potential which corresponds to a reference potential of a driving circuit for driving a data line; and a common electrode potential of a blank period other than the partially scanning period within at least two continued frames is set to a constant potential which is different from the constant potential within the partially scanning period. As a result, the flickering phenomenon can be suppressed.

Also, a driving method, according to another aspect of the present invention, is featured by such a method of driving an active matrix type liquid crystal display device in which while a partial display mode and a normal display mode are switchable, when the partial display mode is selected, a predetermined display operation is carried out in a partial display area which is constituted by an arbitrarily selected number of data lines, and the background is displayed on the remaining background display area; in which: while the respective data lines of the partial display area are scanned in a certain period, in such a case that the period is defined as a frame period; within a period for at least two continued frames, such a time period for scanning the partial display area is defined as a partially scanning period; and a period other than the partially scanning period within the two frame periods is defined as a blank period, a potential of a common electrode is varied only when a period is switched from the partially scanning period to the blank period, and only when a period is switched from the blank period to the partially scanning period. As a consequence, the flickering phenomenon can be reduced.

Further, a liquid crystal display device, according to another aspect of the present invention, is featured by such an active matrix type liquid crystal display device in which while a partial display mode and a normal display mode are switchable, when the partial display mode is selected, a predetermined display operation is carried out in a partial display area which is constituted by an arbitrarily selected number of gate lines, and the background is displayed on the remaining background display area; in which: while the respective gate lines of the partial display area are scanned in a certain period, in such a case that the period is defined as a frame period, "k" pieces (symbol "k" is integer larger than, or equal to 1) of the partial display areas are present within 1 screen, a common electrode potential is varied 2 k times within 1 frame period; a common electrode potential in a partially scanning period for scanning the partial display area is made as a constant potential with respect to a potential which constitutes a reference of a driving circuit for driving the data lines; and within a time period of at least two continued frames, a common electrode potential of a blank period other than the partially scanning period is made as a constant potential which is different from the constant potential in the partially scanning period. As a result, the flickering phenomenon can be reduced.

As previously explained, the present invention can achieve the following effects. That is, when the partial display mode is selected, while the flickering having such a frequency equal to ½ of the frame frequency is suppressed, and also, as explained below, the operations as to both the data line driving circuit and the common electrode driving circuit are stopped, the power consumption of the active matrix type liquid crystal display device can be reduced without any deterioration of picture qualities.

Other objects, features and advantages of the invention will become apparent from the following description of the embodiments of the invention taken in conjunction with the accompanying drawings.

BRIEF DESCRIPTIONS OF THE DRAWINGS

DETAILED DESCRIPTION OF THE EMBODIMENTS

Referring now to drawings, various embodiments of the present invention will be described in detail.

Embodiment 1

Figure 1:
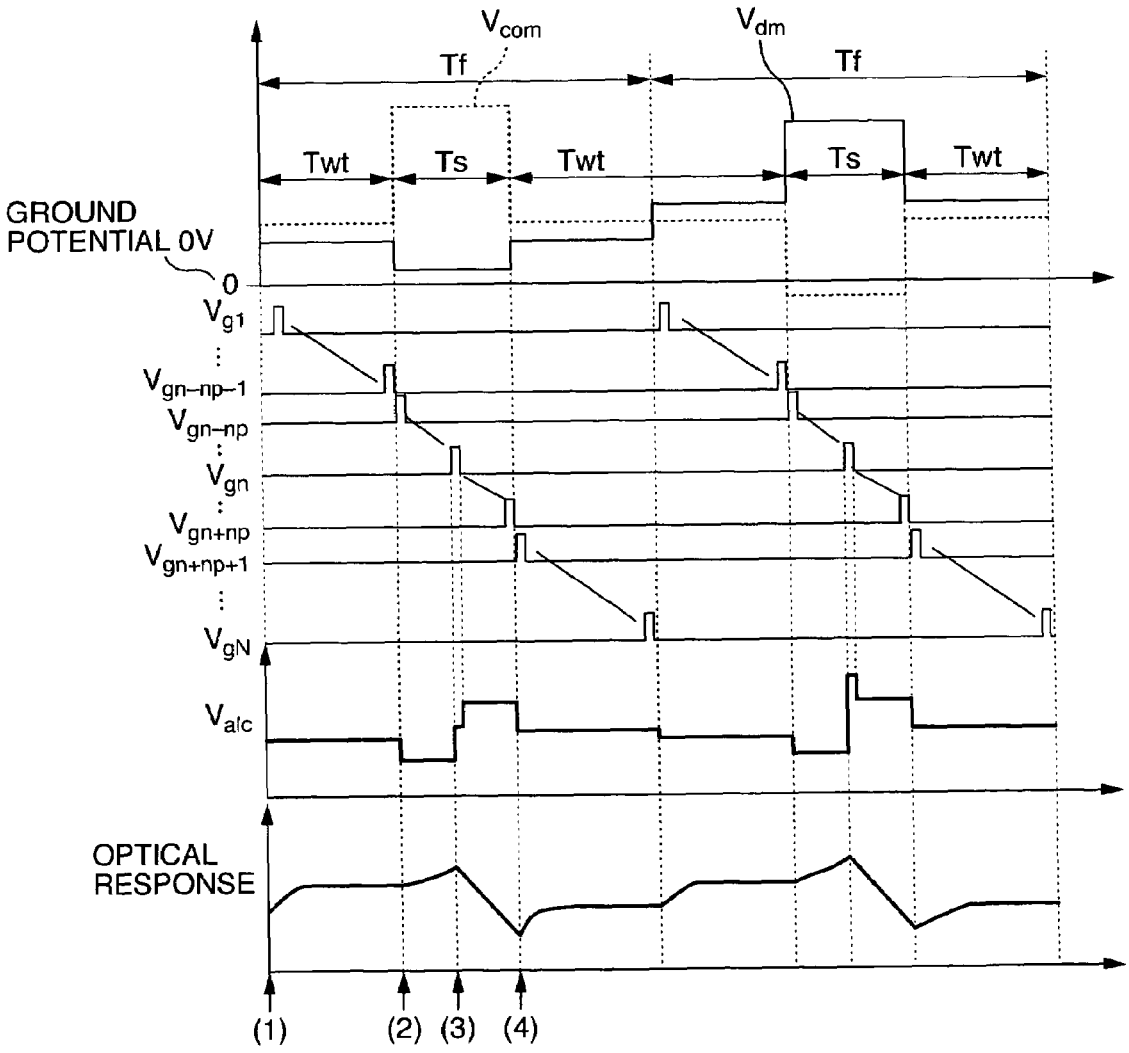
FIG. 1 is a timing chart for explaining a driving method according to an embodiment 1 of the present invention in the case that a partial display operation is carried out.

Now, with reference to FIG. 1, a description is made of summarized operations in the case that a partial display operation is carried out by way of a driving method according to an embodiment 1 of the present invention in pixels defined from an (n−np)-th row up to an (n+np)-th row, which contain a pixel of an n-th row. FIG. 1 represents a timing chart of a driving method for driving two continued frames; a voltage "$V_{alc}$" of a pixel defined by the n-th row and an m-th column; and an optical response of the pixel. This timing chart of the driving method corresponds to such a case that a background display area is displayed in white and a partial display area is displayed in black.

In the two frame periods, such a period other than a partially scanning period Ts will be referred to as a "blank period Twt." In both the partially scanning period Ts and the blank period Twt, counter electrode potentials $V_{com}$ become constant potentials different from each other, and one partial display area is present within the display screen, so that the common electrode potential $V_{com}$ is varied two times within 1 frame period.

In this embodiment 1, it should be understood that a constant potential implies such a potential which is temporally constant with respect to the ground potential (0 V). However, due to electric characteristics of a driving apparatus and a liquid crystal panel, there are some possibilities that a potential of an actual drive signal is varied by approximately 10% from a desirable potential, or is temporally varied by approximately 500 mV. Also, when a time period is switched from the partially scanning period Ts to the blank period Twt, or from the blank period Twt to the partially scanning period Ts, there are some possibilities that a potential variation is continued for either 1 ms or 2 ms until the present potential is reached to the desirable potential due to a transient response. At this time, there are certain possibilities that the magnitude of the potential variation occurred at this time may become approximately 1 V.

The data line potential $V_{dm}$ corresponds to such a potential for displaying the white from the first row up to the (n−np−1)-th row, and becomes a potential for displaying the black from the (n−np)-th row up to the (n+np)-th row, and again becomes such a potential for displaying the white from the (n−np+1)-th row up to the N-th row.

Now, both a white display operation and a black display operation of the liquid crystal panel in this embodiment 1 will be described. As to relative luminance in the case that maximum luminance in a display operation of the liquid crystal panel is assumed as 100% and minimum luminance is assumed as 0%, such a case is defined as a white display operation (alternatively, will also be referred to as "substantially white") in which an absolute value of a difference between a data line potential and a common electrode potential during a scanning operation becomes smaller than, or equal to an absolute value of a difference between potentials for displaying relative luminance higher than, or equal to 90% in a display operation of the liquid crystal panel, whereas such a case is defined as a black display operation (alternatively, will also be referred to as "substantially black") in which an absolute value of a difference between a data line potential and a common electrode potential during a scanning operation becomes larger than, or equal to an absolute value of a difference between potentials for displaying relative luminance lower than, or equal to 10% in a display operation of the liquid crystal panel. Otherwise, a display operation of a pixel to which a data line potential responding to white data is applied is assumed as a white display operation, whereas a display operation of a pixel to which a data line potential responding to black data is applied is assumed as a black display operation.

In the conventional driving method, both the common electrode potential $V_{com}$ and the data line potential $V_{dm}$ were varied at the timing (1). In the driving method of the embodiment 1, the common electrode potential $V_{com}$ becomes constant, the potential variation thereof does not occur, but also, a variation of the voltage $V_{alc}$ does not occur, which is caused by the variation of the common electrode potential $V_{com}$. As a result, a change in optical response waveforms can be reduced.

As to the data line potential $V_{dm}$, the potentials for displaying the white are different from each other in the positive frame and the negative frame in such a manner that the polarity of the voltage applied to the liquid crystal of the pixel of the background display area is inverted every frame at the timing (1). As a result, the data line potential $V_{dm}$ is varied at the timing (1). However, more specifically, in the case of the white display operation, since the voltage applied to the liquid crystal may be alternatively selected to be 0 V, the potential variation as to the data line potential $V_{dm}$ in the timing (1) may be selected to be lower than, or equal to 1 V. In the case of the conventional driving method, the data line potential $V_{dm}$ may cause such a potential variation substantially equal to the maximum amplitude (up to 4 V) of the data line at the timing (1). Therefore, in accordance with the driving method of this embodiment 1, the potential variation can be decreased, as compared with that of the conventional driving method.

Under such a circumstance, as to the voltage $V_{alc}$, since voltage variations occur which cause large optical response changes only at the timing (2) to the timing (4), distortions of optical response waveforms in the blank periods Twt are decreased. As a consequence, the optical response waveform in the positive frame and the optical response waveform in the negative frame can be made more symmetrical than those of the conventional driving method. Accordingly, the flickering having the frequency equal to ½ of the frame frequency can be reduced, and the deteriorations in the picture qualities can be suppressed.

The above-explained example has been exemplified in which the background display area has been scanned every frame in the above-described driving method. In particular, as explained in this embodiment 1, when the background display area is displayed in the substantially white color, the liquid crystal voltage is low, so that a total scanning number as to the background display area can be reduced so as to achieve the low power consumption. In this case, the background display area may be scanned every several frames. Alternatively, the below-mentioned driving method may be carried out. That is, when the display mode is transferred from the normal display mode to the partial display mode, the background display area may be once scanned, and thereafter may not be scanned. The above-described driving method can achieve such an effect that the flickering can be reduced irrespective of the scanning method of the background display area.

In the above-described driving method, in such a case that the frame frequency "fp" in the partial display mode is lower than the frame frequency "fn" in the normal display mode, since such a period "Tsh" for scanning 1 row of the partial display area is made shorter than another period which is simply prolonged in connection with a reduction of the frame frequency, the time interval between the timing (2) and the timing (4) may be shortened. As a result, it is possible to suppress that the flickering produced during this period is increased in connection with the decrease in the frame frequency (in other words, assuming now that a period for scanning 1 row in the normal display mode is "Thn", if Tsh<Thn×fn/fp is satisfied, then the time interval between the timing (2) and the timing (4) may be shortened).

There are two effects capable of suppressing the flickering phenomenon. As the first effect, liquid crystal responds for approximately several ms (milliseconds) with respect to a variation of liquid crystal voltages. As a result, if the time interval between the timing (2) and the timing (4) is short, then the liquid crystal cannot respond to the variation of the liquid crystal voltage, so that the optical response change may be decreased. Next, the second effect is explained. If the time interval between the timing (2) and the timing (4) becomes short, then such a time period that the optical response change occurs becomes short, and this short optical response change becomes pulsatory. In the case that the optical response waveforms during the frame period become such pulsatory simple waveforms, the second effect may be achieved by that both the optical response waveform in the positive frame and the optical response waveform in the negative frame can be readily made symmetrical with each other, and the flickering having the frequency equal to ½ of the frame frequency can be reduced.

Now, a description is made of reductions of electric power. In the most case, electric power of a liquid crystal display becomes equal to averaged electric power of 1 frame. In other words, an averaged electric power value between electric power consumed in a partially scanning period "Ts" and electric power consumed electric power consumed in a blank period "Twt" constitute effective electric power of the liquid crystal display in view of a time elapse. As a consequence, the longer the blank period Twt is prolonged during which an analog circuits and the like can be stopped, the lower the electric power of the liquid crystal display can be reduced.

As a result, in the case that the electric power is reduced by stopping the operation of the analog circuit in the blank period Twt, the period Tsh for scanning 1 row in the partial display mode is made shorter than such a period which is simply prolonged and the frame frequency is reduced (namely, as explained above, it is so set: Tsh<Thn×fn/fp), the partially scanning period Ts corresponding to the time interval between the timing (2) and the timing (4) can be shortened and the blank period Twt can be prolonged, so that the electric power can be reduced.

Figure 2A:
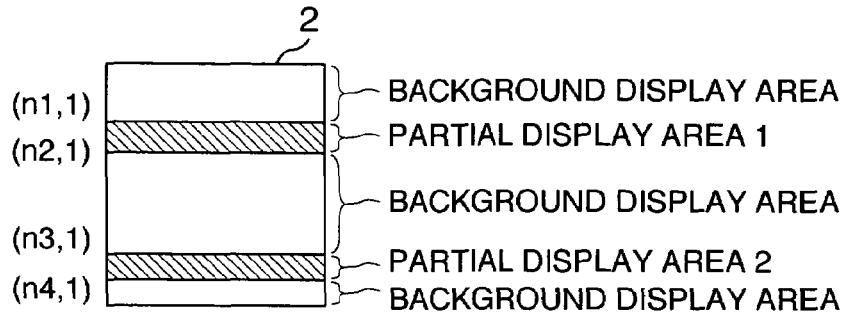
FIG. 2A to FIG. 2C are explanatory diagrams for explaining the driving method according to the embodiment 1 of the present invention in the case that the partial display operation is carried out.
Figure 2B:
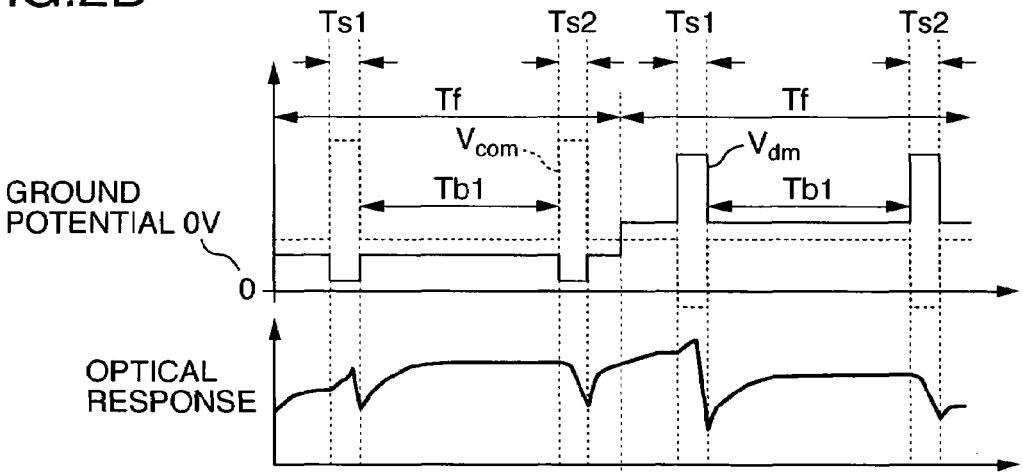
Figure 2C:
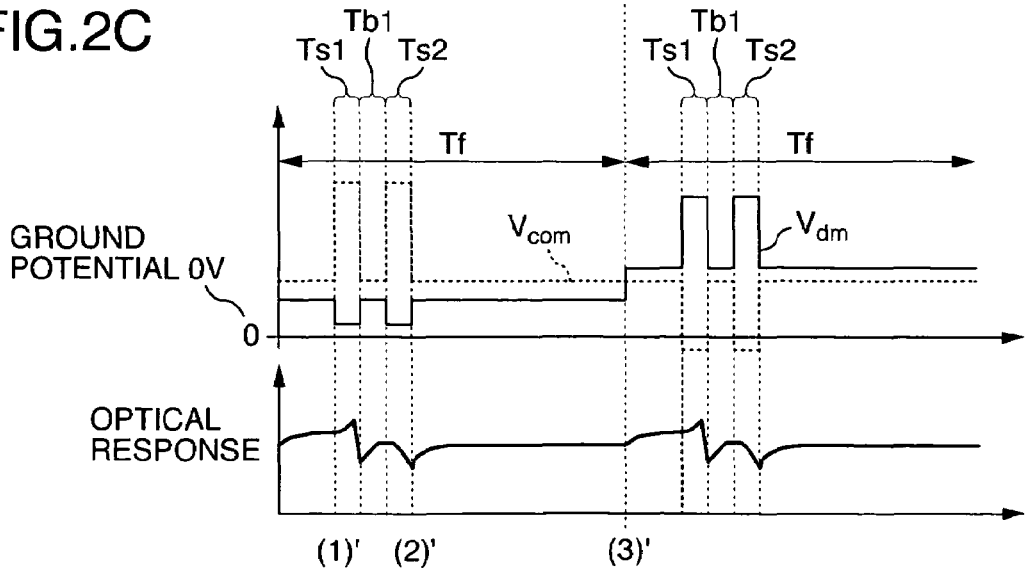

In the above-described driving method, while a period for scanning 1 row of a partial display area is assumed as "Tsh", as represented in FIG. 2A to FIG. 2C, in such a case that there are a partial display area 1 and another partial display area 2, the liquid crystal display device is driven in such a manner that a length "Tb1" of a time period after a scanning operation as to a gate line of an n2-th row has been commenced until a scanning operation as to a gate line of an n3-th row is commenced can satisfy such a relationship of Tb1<Tsh(n3−n2−1). As a result, the flickering can be suppressed. In the partial display area 1, the pixels connected to the gate lines from an n1-th row up to an n2-th row perform display operations. In the partial display area 2, the pixels connected to the data lines from an n3-th row up to an n4-th row perform display operations. In the above description, symbols n1, n2, n3, n4 are positive integers, and relationships are given as follows: n1<n2, n2+1<n3<n4.

This reason is explained with reference to FIG. 2A to FIG. 2C. FIG. 2A shows a display example of the liquid crystal panel 2. FIG. 2B indicates a driving method for sequentially scanning pixels from the gate line of the first row up to the gate line of the N-th row, and shows an optical response of a pixel of an na-th row (symbol "na" indicates positive integer, and relationship is given: n1<na<n2). The length of the period Tb1 is equal to such a length obtained by multiplying a total number (n3−n2−1) of gate lines between the gate line of the n2-th row and the gate line of the n3-th row by the period Tsh for scanning 1 row.

In the above-described embodiment 1, the period for scanning the partial display area 1 has been defined as the partially scanning period "Ts1", whereas the period for scanning the partial display area 2 has been defined as the partially scanning period "Ts2." In this case, since the potentials of both the common electrode and the data line are varied before/after the partially scanning periods Ts1 and Ts2, optical response changes may occur in connection with the potential variations. In the case that the period Tb1 is longer than 1 to 2 ms, two sets of pulse-shaped optical response changes which occur before/after the partially scanning period are present within 1 frame, and an optical response change may occur even in such a period between these pulses. As a result, the optical response waveform is distorted and becomes a complex waveform over the entire frame. As a consequence, the optical response waveform in the positive frame and the optical response waveform in the negative frame may be easily made asymmetrical to each other, and the flickering having the frequency equal to ½ of the frame frequency may be readily produced.

To solve this problem, it is effective to shorten the length of the period Tb1. The reason is given as follows: An adverse influence caused by the optical response change occurred in the period Tb1 can be reduced. A timing chart of a driving method in the case that the length of the period Tb1 is shortened is represented in FIG. 2C.

In this case, while the adverse influence caused by the optical response change in the period Tb1 is small, as to a large optical response change within 1 frame, there are only pulse-shaped optical response changes which are produced in the partially scanning periods Ts1 and Ts2. These partially scanning periods Ts1 and Ts2 are essentially continued to each other. Since these optical response waveforms become simple waveforms, optical response waveforms in the positive frame and the negative frame are made symmetrical to each other, and thus, the flickering having the frequency equal to ½ of the frame frequency can be suppressed.

The method for driving the gate line so as to shorten the length of the period Tb2 may be realized by the below-mentioned driving methods. That is, in one driving method, gate lines from a gate line of a first row up to a gate line of an nb-th row (symbol "nb" is positive integer, relationship is given: n2<nb<n3) are sequentially scanned; a gate line of an n3-th row is scanned subsequent to the gate line of the nb-th line; gate lines from the gate line of the n3-th row up to the gate line of the n4-th row are sequentially scanned; and thereafter the remaining gate lines are scanned. Alternatively, in another driving method, a period for scanning a data line of 1 row when the gate lines defined from the (n2+1)-th row up to the (n3−1)-th row are scanned may be made shorter than a period for scanning a data line of 1 row when other gate lines are scanned, so that the length of the period Tb1 may be shortened.

Also, in another driving method, the gate lines from the gate line of the n1-th row up to the gate line of the n2-th row may be sequentially scanned; thereafter, the gate lines from the gate line of the n3-th row up to the gate line of the n4-th row may be sequentially scanned; and thereafter, the remaining gate lines may be scanned. In this case, it is preferable to shorten the period Tb1 as short as possible, while this period Tb1 is defined after the gate line of the n2-th row has been scanned until the gate line of the n3-th row is scanned. As the best driving method, after the gate line of the n2-th row has been scanned, the gate line of the n3-th row is continuously scanned, so that the period Tb1 is deleted.

In the above-explained driving methods, such a case that the background display area is scanned has been described. The effect capable of suppressing the flickering when the length of the period Tb1 is shortened does not depend upon such a condition as to whether or not the scanning operation of the background display area is carried out.

Embodiment 2

Figure 3:
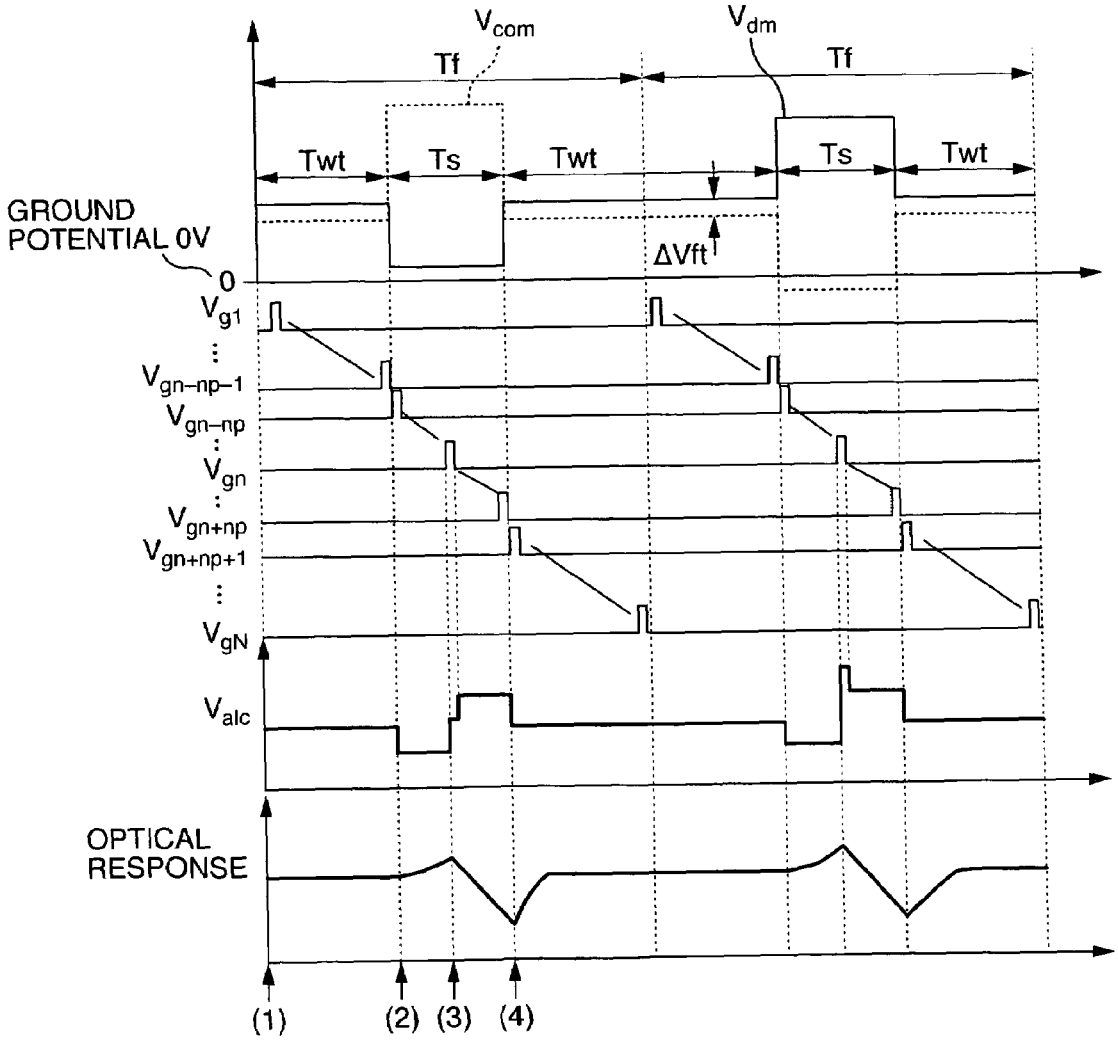
FIG. 3 is a timing chart for explaining a driving method according to an embodiment 2 of the present invention in the case that a partial display operation is carried out.

As indicated in FIG. 3, a driving method of an embodiment 2 of the present invention is featured by that in the driving method explained in the embodiment 1, a potential at a data line in a blank period Twt is kept constant. This driving method of the embodiment 2 will now be explained. Operations executed in such a case that a partial display operation is carried out in pixels defined from an (n−np)-th row up to an (n+np)-th row, which contain a pixel of an n-th row, will now be summarized.

FIG. 3 shows a timing chart of a driving method for driving two continued frames; a voltage "$V_{alc}$" of a pixel defined by the n-th row and an m-th column; and an optical response of the pixel. This timing chart of the driving method corresponds to such a case that a background display area is displayed in white and a partial display area is displayed in black. In both a partially scanning period Ts and a blank period Twt, counter electrode potentials $V_{com}$ become constant potentials different from each other, and one partial display area is present within a display screen, so that the common electrode potential $V_{com}$ is varied two times within 1 frame period.

A data line potential $V_{dm}$ becomes such a potential for displaying a black color within the partially scanning period Ts, and becomes such a potential for displaying a white color within the blank period Twt. As to a polarity of a voltage which is applied to liquid crystal of pixels of the background display area, the voltage is inverted every several frames. Alternatively, in particular, in the case that the white color is displayed, the polarity itself of the liquid crystal voltage may be eliminated by that the data line potential $V_{dm}$ is made constant in such a manner that a liquid crystal voltage to be applied becomes substantially zero. Within a period longer than at least two continued frame periods, the data line potentials $V_{dm}$ of the blank period Twt are made constant.

In the case of FIG. 3, the data line potential $V_{dm}$ of the blank period Twt has been set to such a potential that the liquid crystal voltage becomes substantially zero, and has been set to such a potential higher than a common electrode potential $V_{com}$ by a voltage "ΔVft", while a feed-through is considered. Since such a potential setting operation is carried out, the data line potential need not be varied so as to invert the polarity. It should be understood that since the liquid crystal voltage may merely become substantially zero, it is no necessity that the data line potential $V_{dm}$ is strictly made higher than the common electrode potential $V_{com}$ by the voltage ΔVft. Alternatively, there is no problem that the data line potential $V_{dm}$ may be shifted from the desirable potential by approximately 500 mV.

In the conventional driving method, both the common electrode potential $V_{com}$ and the data line potential $V_{dm}$ were varied at the timing (1). In the driving method of the embodiment 2, both the data line potential $V_{dm}$ and the common electrode potential $V_{com}$ are constant potentials in the blank period Twt, which do not cause a potential variation.

As a result, the voltage $V_{alc}$ is varied only at the timing (2) to the timing (4), and thus, only distortions of optical response waveforms in the blank periods Twt are decreased. As a consequence, the optical response waveform in the positive frame and the optical response waveform in the negative frame can be made more symmetrical than those of the conventional driving method. Accordingly, the flickers having the frequency equal to ½ of the frame frequency can be reduced, and the deteriorations in the picture qualities can be suppressed.

The above-explained example has been exemplified in which the background display area has been scanned every frame in the above-described driving method. In particular, when the background display area is displayed in the white color, the liquid crystal voltage is low, so that a total scanning number as to the background display area can be reduced so as to achieve the low power consumption. In this case, the background display area may be scanned every several frames. Alternatively, the below-mentioned driving method may be carried out. That is, when the display mode is transferred from the normal display mode to the partial display mode, the background display area may be once scanned, and thereafter may not be scanned. Even the above-described driving method can achieve such an effect that the flickering phenomenon can be reduced.

Furthermore, in the case that both the common electrode potential $V_{com}$ and the data line potential $V_{dm}$ in the blank period Twt are made constant, it is preferable that both the common electrode potential $V_{com}$ and the data line potential $V_{dm}$ are equal to the same potential. It should also be noted that due to electric characteristics of a driving apparatus and a liquid display panel, actually, a potential difference may be produced between two driving signals, and a magnitude of this potential difference is mostly lower than, or equal to 100 mV (will also be referred to as "substantially same potentials"). Since a data line is shortcicuited to a common electrode so as to make both the potentials equal to each other, a data line driving circuit need not apply any potential to the data line, and thus, electric power of this data line driving circuit can be reduced.

Also, in such a case that a frame period is long, there is such a problem that a voltage variation of the voltage $V_{alc}$ is caused by a leak current.

However, in the case that the data line potential $V_{dm}$ is made equal to the common electrode potential $V_{com}$, the leak currents in the blank period Twt in the pixels of the partial display area can be suppressed in the same levels within both the positive frame and the negative frame. As a result, a voltage drop of the voltage $V_{alc}$ caused by the leak current in the positive frame may become substantially equal to a voltage drop of the voltage $V_{alc}$ caused by the leak current in the negative frame, so that optical response waveforms in both the positive frame and the negative frame may become symmetrical to each other. As a result, the flickering having the frequency equal to ½ of the frame frequency can be reduced, and the deteriorations in the picture qualities can be suppressed.

Furthermore, in the case that both the common electrode potential $V_{com}$ and the data line potential $V_{dm}$ in the blank period Twt are made constant, and also that both the common electrode potential $V_{com}$ and the data line potential $V_{dm}$ are equal to the same potential, it is so assumed that a display operation of the background display area, is set to such a display operation when the liquid crystal voltage is substantially equal to zero. Then, since the background display area is not scanned, the deterioration of the picture quality is suppressed, and the low power consumption can be realized. When the display mode of the liquid crystal display apparatus is normally close, the display mode of the background display area is black, whereas when the display mode of the liquid crystal display apparatus is normally open, the display mode of the background display area is white.

As to a writing operation of the background display area, after the display mode has been transferred from the normal display mode to the partial display mode, or when the partial display mode is carried out, the writing operation is carried out during several frames after the display content is changed.

Figure 4:
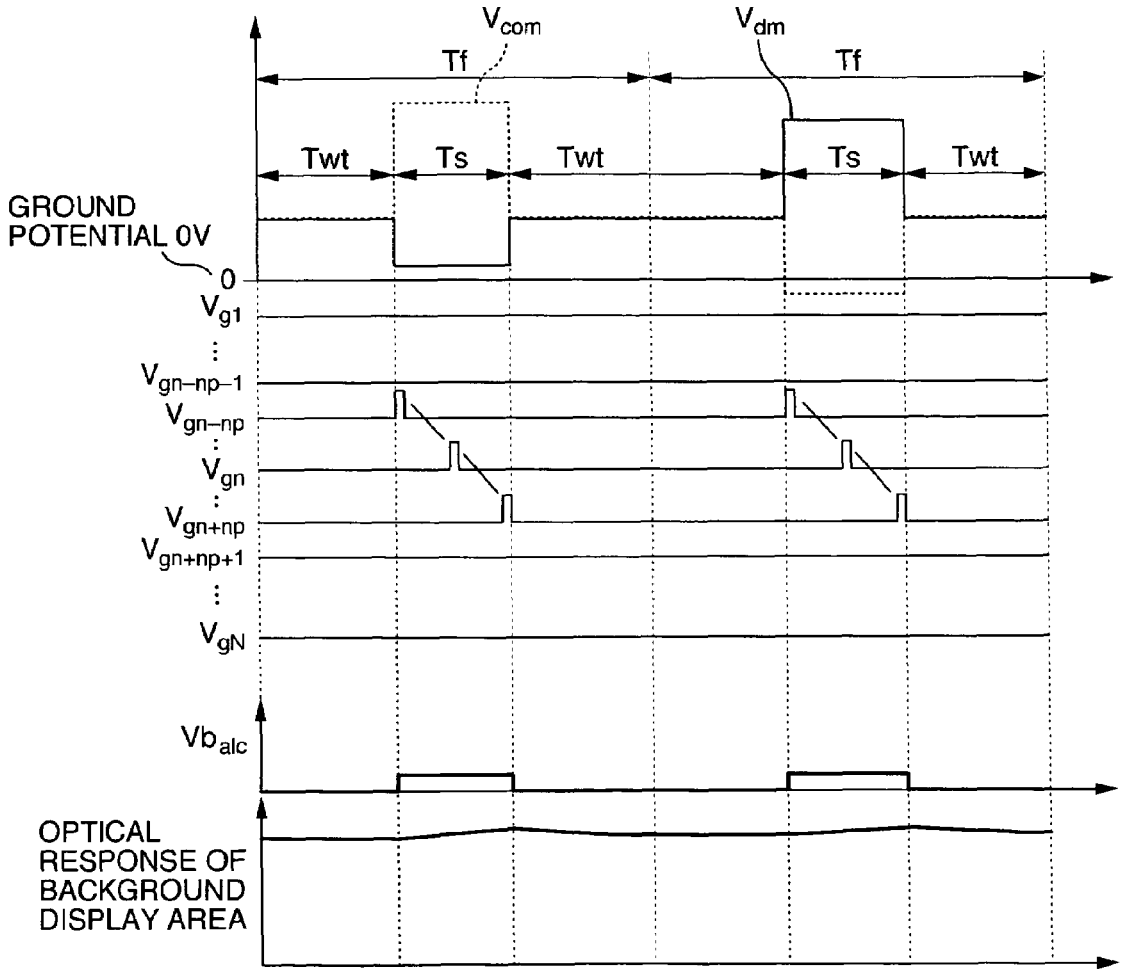
FIG. 4 is a timing chart for explaining a driving method according to the embodiment 2 of the present invention in the case that a partial display operation is carried out.

Referring now to FIG. 4, a driving method executed in this case will be described in detail. FIG. 4 shows a timing chart of a driving method for two continuous frames in the case that a partial display operation is carried out in pixels defined from an (n−np)-th row up to an (n+np)-th row, which contain the pixel of the n-th row; and FIG. 4 represents a voltage "$Vb_{alc}$" of pixels of the background display area, and also shows an optical response of the background display area.

This timing chart of the driving method corresponds to such a case that the background display area is displayed in a white color, whereas the partial display area is displayed in a black color. The gate line of the background display area is under "low" state. Even when the TFT is brought into an OFF state, a leak current flows, and a pixel electrode potential is varied at a potential responding to such a potential difference between a data line potential $V_{dm}$ and a common electrode potential $V_{com}$. In such a case that the data line potential $V_{dm}$ is equal to the common electrode potential $V_{com}$, the pixel electrode potential is converged to the potential equal to the common electrode potential $V_{com}$ in connection with a time elapse.

In other words, even when the gate line of the background display area is under the "low" state, in the case that the data line potential $V_{dm}$ is equal to the common electrode potential $V_{com}$, the liquid crystal voltage is converged to a zero voltage. Since the data line potential $V_{dm}$ becomes equal to the common electrode potential $V_{com}$ in the blank period Twt, the liquid crystal voltage is varied to be directed to the zero voltage in this blank period Twt. In the case that the blank period Twt is longer than the partially scanning period Ts, since the liquid crystal voltage is dropped due to the leak current in the blank period Twt, the voltage $Vb_{alc}$ becomes substantially equal to a zero voltage after several frames. As a consequence, the display of the background display area becomes white and this display is maintained.

Even in such a case that the gate line of the background display area is under the "low" state, the voltage $Vb_{alc}$ causes a potential variation before/after the partially scanning period Ts mainly due to parasitic coupling. However, since the data line and the common electrode are returned to the same potentials before/after the partially scanning period Ts, the voltages $Vb_{alc}$ may become substantially equal to each other before/after the partially scanning period Ts. As a consequence, the display conditions of the background display area may become substantially equal to each other in the blank periods Twt before/after the partially scanning period Ts.

A description is made of an adverse influence which is caused by a potential variation and is given to a display condition of the background display area in the partially scanning period Ts, while the potential variation occurs when the time period is switched from the blank period Twt to the partially scanning period Ts. Since an effective value of a liquid crystal voltage depending characteristic of luminance on the liquid crystal panel is non-linear, in the case of a white display, even when the voltage $Vb_{alc}$ is changed within a range from approximately 0 V to 1 V, an optical response is not substantially adversely influenced. As a consequence, since the display content of the background display area is made in the white color, the optical response in the display content of the background display area may not be substantially adversely influenced by variations in the data line potential and the common electrode potential.

In such a case that the data line potential $V_{dm}$ and the common electrode potential $V_{com}$ are equal to each other and the blank period Twt is longer than the partially scanning period Ts, if such a potential that the liquid crystal voltage becomes zero when the background display area is scanned is applied to the pixel electrode, then the stable potential of the pixel electrode thereafter becomes such a potential equal to the common electrode potential $V_{com}$, so that the liquid crystal voltage may maintain substantially zero V. As a result, the scanning operation of the background display area need not be carried out.

Also, in such a case that the scanning operation is carried out every several frames without stopping the scanning operation of the background display area in the above-described driving method, the data line potential is varied so as to perform a polarity inverting operation of the background display area every several frames. As a result, an optical response change may be produced in connection with the potential variation of the data line, and may be sensed as a flickering phenomenon in the partial display area.

For instance, in the case that the liquid crystal display is driven in the frame frequency of 60 Hz and the background display area is scanned every 10 frames, there are some possibilities that the optical response waveform of the partial display area is distorted every 10 frames. In this case, the distortion as to the optical response waveform of the partial display area may be sensed as the flicking of 6 Hz, depending on a degree of the distortions. Stopping of the scanning operation may also have such an effect that this flickering phenomenon of 6 Hz may be reduced.

In other words, such a condition is established that both the common electrode potential $V_{com}$ and the data line potential $V_{dm}$ in the blank period Twt are made constant, and further both the common electrode potential $V_{com}$ and the data line potential $V_{dm}$ are equal to the same potentials, and also, a display operation of the background display area is set to such a display operation when the liquid crystal voltage is substantially equal to zero, the background display area need not be scanned in the blank period Twt, but also, the flickering can be suppressed and the liquid crystal display device can be operated in low power consumption. As to the above-described display operation of the background display area, when the display mode of the liquid crystal display device is normally close, the display mode of the background display area is black, whereas when the display mode of the liquid crystal display device is normally open, the display mode of the background display area is white.

Furthermore, in the case that both the common electrode potential $V_{com}$ and the data line potential $V_{dm}$ in the blank period Twt are made constant, and both the common electrode potential $V_{com}$ and the data line potential $V_{dm}$ are equal to the same potentials, the following potential setting conditions are preferable. That is, potentials at the data line and the common electrode in the blank period Twt are set lower than, or equal to the highest potential within the data line potentials of the partially scanning period Ts, and are set to constant potentials higher than the ground potential.

This reason is given as follows: That is, generally speaking, a data line driving circuit has been manufactured based upon such an initial condition that this data line driving circuit is operated within a potential range defined from the ground potential up to the highest potential in the data line potentials of the partially scanning period Ts. As a consequence, if the data line potential is selected to be a potential outside this potential range, there is a risk that the data line driving circuit may be destroyed, or may be erroneously operated.

Moreover, in the case that both the common electrode potential $V_{com}$ and the data line potential $V_{dm}$ in the blank period Twt are made constant, and both the common electrode potential $V_{com}$ and the data line potential $V_{dm}$ are equal to the same potentials, and in addition, potentials at the data line and the common electrode in the blank period Twt are set lower than, or equal to the highest potential within the data line potentials of the partially scanning period Ts, and are set to constant potentials higher than the ground potential, it is desirable that both the common electrode potential $V_{com}$ and the data line potential $V_{dm}$ in the blank period Twt are set to the ground potential.

In this case, when both the common electrode potential $V_{com}$ and the data line potential $V_{dm}$ are set to the ground potential, there are some possibilities that the common electrode potential $V_{com}$ and the data line potential $V_{dm}$ are different from the ground potential by approximately 10 mV to 100 mV due to the electric characteristics of both the driving apparatus and the liquid crystal panel.

Since the ground potential corresponds to a reference potential and need not be produced in a circuit, the common electrode potential $V_{com}$ is shortcircuited to the ground potential, so that the circuit for driving the common electrode can be stopped and can be operated in low power consumption. Furthermore, the ground potential corresponds to only such one potential that even when a current flows from the liquid crystal panel, the battery energy of the cellular telephone cannot be consumed, and thus, since the ground potential is set to both the common electrode potential $V_{com}$ and the data line potential $V_{dm}$ in the blank period Twt, the standby time thereof can be prolonged.

Also, in such a case that both the common electrode potential $V_{com}$ and the data line potential $V_{dm}$ in the blank period Twt are set to the ground potential, there are some necessities that the gate line potential of the partial display area is set to be higher than, or equal to an absolute value of a potential difference between the common electrode potential $V_{com}$ and the ground potential in the partially scanning period Ts of the negative frame, and also, is set to be lower than the ground potential.

Figure 5A:
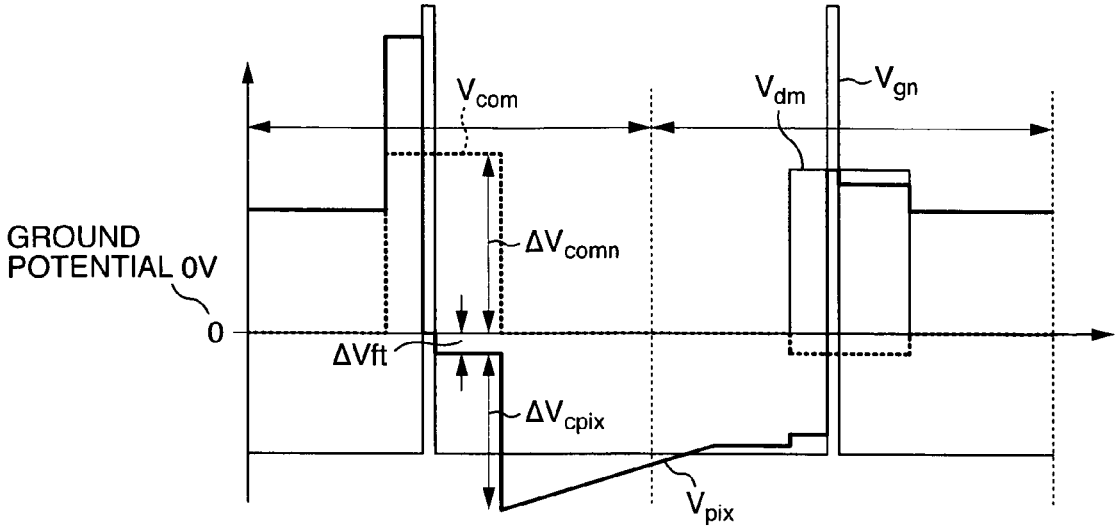
FIGS. 5A, 5B are timing charts for explaining a driving method according to the embodiment 2 of the present invention in the case that a partial display operation is carried out.
Figure 5B:
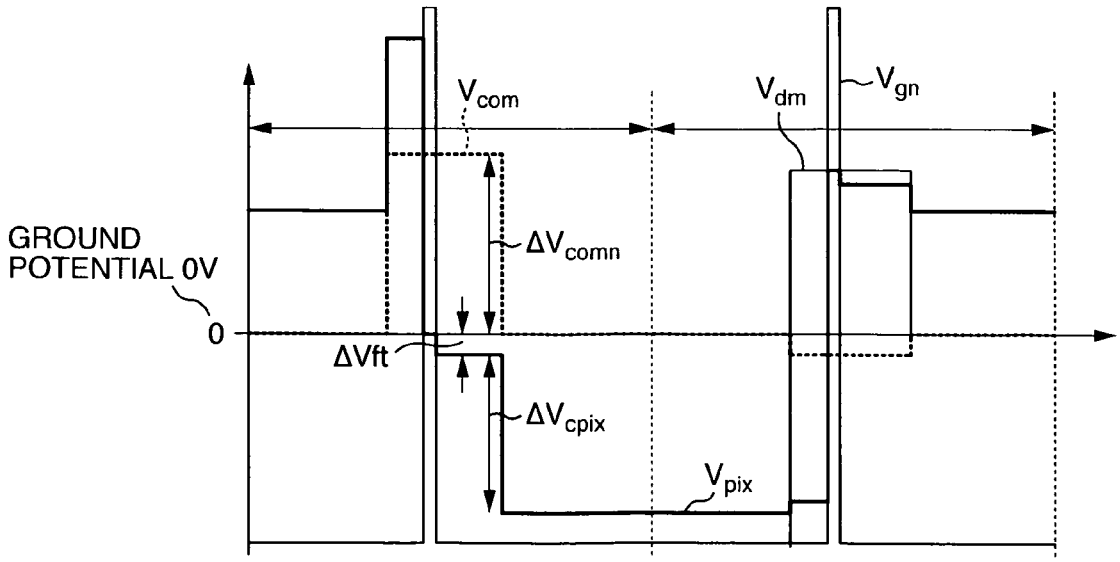

This potential setting operation will now be explained with reference to FIG. 5A and FIG. 5B. FIG. 5A and FIG. 5B indicate timing charts for driving signals as to a pixel defined by an n-th row and an m-th column for two continuous frames, while the ground potential is employed as a reference, and further, represent pixel electrode potentials "$V_{pix}$" of this pixel driven by this drive scheme. FIG. 5A and FIG. 5B show timing charts in the case that the highest liquid crystal voltage is applied to a pixel of the partial display area.

In the negative frame, when the time period is transferred from the partially scanning period to the blank period, the common electrode potential $V_{com}$ is dropped only by "$\Delta V_{comn}$." In response to this potential drop, the pixel electrode potential $V_{pix}$ is dropped by such a voltage "$\Delta V_{cpix}$." Although the magnitude of this voltage $\Delta V_{cpix}$ is smaller than the above-described voltage $\Delta V_{comn}$ due to the presence of the parasitic capacitor, this magnitude may be substantially equal to the voltage $\Delta V_{comn}$. At this time, the pixel electrode potential $V_{pix}$ is nearly equal to "$-(\Delta Vft+\Delta v_{comn})$."

In the case of FIG. 5A, when the gate line potential $V_{gn}$ becomes higher than the pixel electrode potential $V_{pix}$ in the blank period, the TFT is brought into an ON state, and thus, the image data held in the TFT is rewritten, so that a desirable display operation cannot be carried out. As a consequence, as shown in FIG. 5B, the gate line potential $V_{gn}$ in the blank period must be lowered than the pixel electrode potential $V_{pix}$ which is nearly equal to $-(\Delta Vft+\Delta V_{comn})$.

As to the feed-through voltage ΔVft, there are many cases that this feed-through voltage ΔVft is lower than, or equal to approximately 1 V, and is lower than the voltage $\Delta V_{comn}$, namely can be neglected. Also, the feed-through voltage ΔVft may be decreased up to approximately 100 to 10 mV by improving the element designing manners, and also by improving the methods for driving both the data line and the gate line in the partially scanning period.

To the contrary, in such a case that the driving scheme of the common electrode is selected to be the above-explained driving scheme shown in FIG. 5A, or FIG. 5B, the voltage $\Delta V_{comn}$ cannot be decreased. As a consequence, in the case that the driving scheme of the common electrode is selected to be the above-explained driving scheme shown in FIG. 5A, or FIG. 5B, at least the gate line potential $V_{gm}$ for the blank period must be selected to be lower than the potential $-\Delta V_{comn}$.

Furthermore, in such a case that both the common electrode potential $V_{com}$ and the data line potential $V_{dm}$ in the blank period are made constant, a tone number (gradation number) in each of pixels is reduced to two levels, and values which can be achieved by the data line potential $V_{dm}$ in the partially scanning period are selected to be a binary value. As a result, in the partially scanning period, the driving circuit of producing the tone other than the circuit for generating the potentials having the binary values can be stopped, or the consumption current consumed in this circuit can be reduced. As a result, the electric power of the analog circuit in the data line driving circuit can be reduced.

At this time, the values which may be realized by the data line potential $V_{dm}$ within 1 frame are 3 in maximum, while two values are employed in the partially scanning period, and one value is employed in the blank period. It should also be noted that the data line potential $V_{dm}$ of the blank period may become equal to any one potential of the two data line potentials $V_{dm}$ in the partially scanning period.

Embodiment 3

The above-explained embodiments 1 and 2 relate to the driving methods for suppressing the deteriorations of the picture qualities and for reducing the power consumption. This embodiment 3 of the present invention is directed to a reduction of electric power as to a driving apparatus of a liquid crystal display device.

In this embodiment 3, while a partial display mode and a normal display mode can be switched, an active matrix type liquid crystal display device is provided with the below-mentioned driving apparatus, and the liquid crystal display device performs a desirable display operation on a partial display area constituted by an arbitrarily-selected number of gate lines, and displays the background on the remaining background display area when the partial display mode is selected. In the driving apparatus, the respective gate lines of the partial display area are scanned in a certain period, and this period is set as a frame period; in such a case that "k" pieces (symbol "k" is integer larger than, or equal to 1) of the partial display areas are present in one screen, a common electrode potential is varied 2k times within 1 frame period; a common electrode potential of a partially scanning period for scanning the partial display area is made constant with respect to the ground potential which corresponds to a reference potential of a driving circuit for driving a data line; and a common electrode potential of a blank period other than the partially scanning period within at least two continued frames is set to a constant potential which is different from the constant potential within the partially scanning period. Since the above-described driving apparatus is provided, the flickering having frequency equal to ½ of the frame frequency can be suppressed, the frame frequency can be reduced, and the liquid crystal display device can be operated under low consumption.

Figure 6:
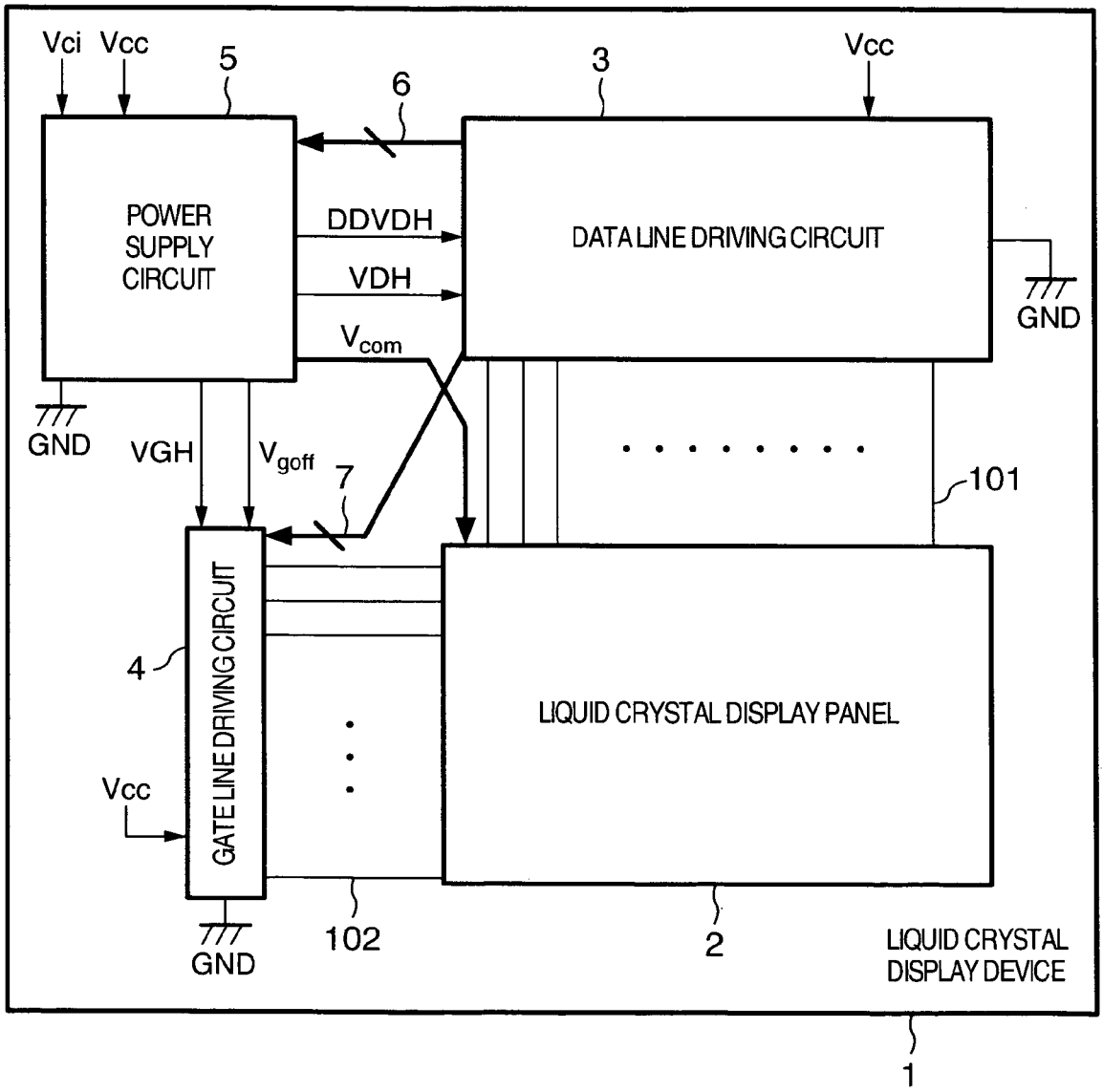
FIG. 6 is a schematic block diagram for representing a liquid crystal display device according to an embodiment 3 of the present invention.

FIG. 6 is a block diagram for showing a detailed content of the liquid crystal display device 1. This liquid crystal display device 1 contains a liquid crystal panel 2, a data line driving circuit 3, a gate line driving circuit 4, and a power supply circuit 5, which function as the driving apparatus. A circuit for driving the common electrodes has been built in the power supply circuit 5. The data line driving circuit 3 controls both the power supply circuit 5 and the gate line driving circuit 4. A control signal groups from the data line driving circuit 3 to the power supply circuit 5 is expressed by a reference numeral 6. This control signal group 6 is inputted to the power supply circuit 5. Another control signal group to the gate line driving circuit 4 is indicated by a reference numeral 7, and this control signal group 7 is inputted to the gate line driving circuit 4.

Both the power supply potentials "Vcc" and "Vci" are supplied from the cellular telephone. Also, the ground potential (GND) is entered to the respective driving circuits. Also, control data corresponding to information which is used to define various sorts of operations of the driving circuits is transferred from the cellular telephone to the liquid crystal display device. As the information as to the control data, there are various sorts of parameters such as a display line number, a frame frequency, a color number, and the like. In this embodiment 3, while the control data is stored in a control register employed in the data line driving circuit 3, the data line driving circuit 3 may control the respective driving circuits based upon the control data. In the power supply circuit 5, power supply potentials of the respective driving circuits based upon the power supply potential Vci.

Figure 7:
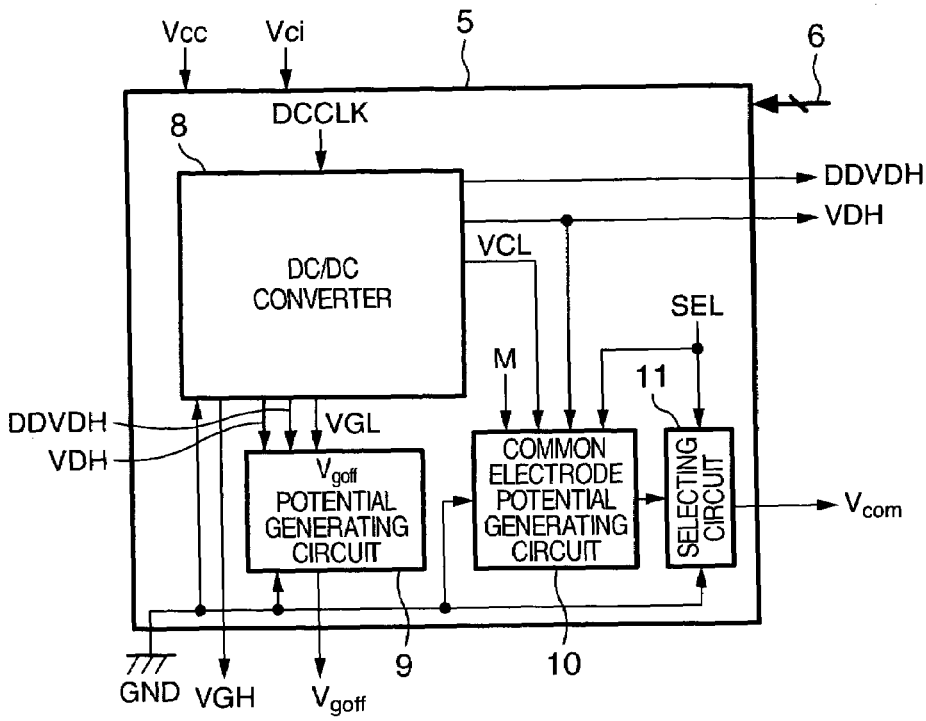
FIG. 7 is a schematic block diagram of a power supply circuit employed in the liquid crystal display device according to the embodiment 3 of the present invention.

FIG. 7 is a block diagram for representing a detailed content of the power supply circuit 5. The power supply circuit 5 contains a DC/DC converter 8, a $V_{goff}$ potential generating circuit 9, a common electrode generating circuit 10, and a selecting circuit 11. The DC/DC converter 8 produces various sorts of analog potentials based upon the power supply potential Vci. The $V_{goff}$ potential generating circuit 9 generates such a potential which corresponds to a "low gate potential." The common electrode potential generating circuit 10 generates common electrode potentials in the partially scanning periods when the normal display mode is selected and the partial display mode is selected. Both the common electrode potential outputted from the common electrode potential generating circuit 10 and a standby potential are inputted to the selecting circuit 11, and then, the selecting circuit 11 selects any one of these two input potentials to output the selected potential to the common electrode.

The DC/DC converter 8 contains a regulator circuit and a charge pump circuit. The charge pump circuit boosts/inverts either the power supply potential Vci or a potential outputted from the regulator circuit is synchronism with a boosting clock DCCLK. The charge pump circuit produces a power supply potential DDVDH of the gate line driving circuit 3; another potential VDH which constitutes a reference potential on the high potential side when a grayscale potential (reference potential on low potential side constitutes GND); both a potential VGH corresponding to a "high gate line potential" and a potential VGL which is used in the $V_{goff}$ potential producing circuit 9; and a potential VCL which is used in the common electrode potential generating circuit 10. The above-explained potential VGL corresponds to such a potential obtained by inverting the potential VGH, and is used as the minus-sided power supply with respect to the ground potential GND of the $V_{goff}$ potential generating circuit 9. The above-described potential VCL corresponds to either the power supply potential Vci or such a potential obtained by inverting the potential generated by the regulator circuit, and is used as the minus-sided power supply with respect to the ground potential GND of the common electrode potential generating circuit 10.

When the frequency of the boosting clock

DCCLK is high, since the boosting inverting number is large, even if a large current flows in the circuit which uses the potential outputted from the DC/DC converter, this potential can be kept stable. In other words, large currents may be supplied to the respective driving circuits. However, when the frequency of the boosting clock DCCLK is low, since the boosting inverting number is small, if a large current flows in the circuit which uses the potential outputted from the DC/DC converter, the current cannot be sufficiently supplied, but also this potential cannot be kept stable.

The common electrode potential generating circuit 10 generates both a common electrode potential "$V_{comH}$" and a potential "$V_{comL}$" in a partially scanning period when the normal display mode is selected, and when the partial display mode is selected. The common electrode potential generating circuit 10 outputs any one of these potentials to the selecting circuit 11 in accordance with a control signal M which corresponds to one signal contained in the control signal group.

The selecting circuit 11 outputs any one of the potential and the standby potential entered from the common electrode potential generating circuit 10 in accordance with a selection signal SEL which corresponds to one signal contained in the control signal group 6 entered in the selecting circuit 11. This selection signal SEL takes two states (first state and second state). The selecting circuit 11 is arranged in such a manner that when the selection signal SEL corresponds to the first state, the selecting circuit 11 selects the potential outputted from the common electrode potential generating circuit 10, whereas when the selection signal SEL corresponds to the second state, the selecting unit 11 selects the standby potential.

In the above-explained circuit arrangement, since such a control circuit is employed in the liquid crystal display device, this liquid crystal display device can simply realize the methods for driving the common electrodes as explained in the embodiment 1 and the embodiment 2. That is, when the normal display mode is selected, the control circuit sets the selection signal SEL to the first state, whereas when the partial display mode is selected, the control circuit sets the selection signal SEL to the first state during the partially scanning period, and sets the selection signal SEL to the second state during the standby period.

The standby potential inputted to the selecting circuit 11 is selected to be the ground potential which is equal to only one potential by which the battery energy of the cellular telephone is not consumed even when the current flows from the liquid crystal panel, so that the electric power can be reduced. Also, such a circuit itself which generates the standby potential need not be provided in the liquid crystal display device, and thus, the electric power can be reduced without increasing the circuit scale. FIG. 7 shows such a case that the ground potential GND is inputted as the standby potential to the selecting circuit 11.

Also, the selection signal SEL is inputted to the common electrode potential generating circuit 10. In the case that the selection signal SEL corresponds to the second state, either a portion or all of the internal circuits within the common electrode potential generating circuit 10 are stopped, or currents flowing through the internal circuits can be reduced. As a result, the electric power of the common electrode potential generating circuit 10 consumed in such a case that the selection signal SEL corresponds to the second state can be made lower than the electric power of the common electrode potential generating circuit 10 consumed in such a case that the selection signal SEL corresponds to the first state.

Since the selection signal SEL is inputted to the common electrode potential generating circuit 10 in order that the electric power of this common electrode potential generating circuit 10 can be controlled by the selection signal SEL, the electric power of the common electrode potential generating circuit 10 can be reduced in synchronism with the selecting circuit 11, which may be realized by the simple circuit arrangement. It should also be understood that the selection signal SEL inputted to the selecting circuit 11 may be made equal to the selection signal SEL entered to the common electrode potential generating circuit 10, or may be alternatively made different from the last-mentioned selection signal SEL.

Figure 8:
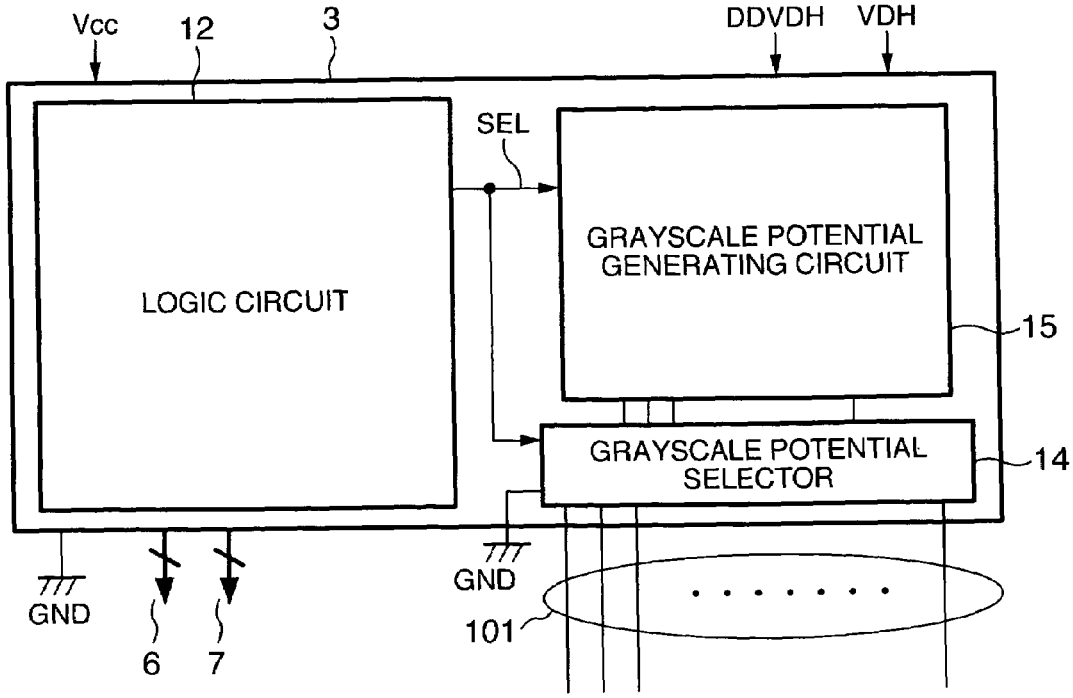
FIG. 8 is a schematic block diagram for showing a data line driving circuit employed in the liquid crystal display device according to the embodiment 3 of the present invention.

Next, FIG. 8 is a block diagram for mainly showing the data line driving circuit 3 of this embodiment 3. The data line driving circuit 3 is provided with a logic circuit 12, a grayscale potential generating circuit 15, and a grayscale potential selector 14. The logic circuit 12 is constituted by a control circuit for controlling the respective circuits, a control register for holding control data which define operations of this control circuit, a system interface (I/F) which functions as an interface with the cellular telephone, a memory for storing thereinto image data, and the like.

The logic circuit 12 produces the selection signal SEL based upon the control data stored in the control register, and sets the selection signal SEL to the first state in the partially scanning period when the normal display mode is selected and the partial display mode is selected, and also sets the selection signal SEL to the second state in the blank period.

Concretely speaking, for example, the below-mentioned 1-bit control data PMODE is prepared. In the case that the driving operation of the partial display-mode as explained in the embodiments 1 and 2 is carried out, this control data PMODE becomes "1", whereas in other cases, this control data PMODE becomes "0." When the control data PMODE is "0", the logic circuit 12 sets the selection signal SEL to the first state, whereas when the control data PMODE is "1", the logic circuit 12 sets the selection signal SEL to the first state in the partially scanning period, and sets the selection signal SEL to the second state in the blank period. Issuing of the control data PMODE is carried out by a CPU of a main body of the cellular telephone provided outside the liquid crystal display device. The CPU of the cellular telephone main body issues the control data PMODE in conjunction with the use condition of the cellular telephone. In this example, the following description has been made that the control data PMODE is selected to be 1 bit, and the control operation for the driving method based upon the control data PMODE is carried out. However, the present invention is not limited only to this example.

The selection signal SEL is transmitted to the power supply circuit 5. Also, in the data line driving circuit 3, the selection signal SEL is transmitted from the logic circuit 12 to the grayscale potential selector 14 and the grayscale potential generating circuit 15.

The grayscale potential generating circuit 15 generates the grayscale potential by dividing such a potential between the ground potential GND and the potential VDH by using a resistor. In the case of a liquid crystal display device having a 64-grayscale representation, the grayscale potential generating circuit 15 generates 64 pieces of grayscale potentials. To generate the grayscale potentials, an operational amplifier is provided inside the grayscale potential generating circuit 15.

In the case that the standby potential is lower than, or equal to the highest potential of the data line potential in the partially scanning period, and is higher than, or equal to the ground potential, this standby potential is applied to the data line driving circuit 3. When the selection signal SEL corresponds to the first state, the grayscale potential selector 14 selects the grayscale potential produced in the grayscale potential generating circuit 15 based upon the image data, and then, applies the selected grayscale potential to the data line 101. When the selection signal SEL corresponds to the second state, the grayscale potential selector 14 selects the standby potential, and then, applies the selected standby potential to the data line 101.

In the case that the selection signal SEL corresponds to the second state, either a portion or all of the internal circuits within the grayscale potential generating circuit 15 are stopped, or currents flowing through the internal circuits thereof can be reduced. As a result, the electric power of the grayscale potential generating circuit 15 when the selection signal SEL corresponds to the second state can be reduced as compared with the electric power of the grayscale potential generating circuit 15 when the selection signal SEL corresponds to the first state. In particular, the current flowing through the operational amplifier in the grayscale potential generating circuit 15 is reduced, so that the electric power thereof can be lowered.

In this embodiment 3, the selection signal SEL which is transferred to the power supply circuit has been employed as the signal for controlling both the grayscale potential selector 14 and the grayscale potential generating circuit 15, but the present invention is not limited thereto. As to the signals for controlling the grayscale potential selector 14 and the grayscale potential generating circuit 15, such a signal identical to the selection signal SEL may be alternatively employed, or separate signals may be used.

In the above-described arrangement, in the case that the standby potential is selected to the ground potential, during such a time period that the selection signal SEL is the second state, the potential which must be produced in the liquid crystal display device is only the $V_{goff}$ potential. As a consequence, since the current amount supplied by the DC/DC converter may be decreased, the boosting clock DCCLK can be reduced. Since the electric power of the charge pump circuit is directly proportional to the boosting clock frequency, the electric power can be lowered. Since the above-explained arrangement is employed, the electric power of both the data line driving circuit and of the power supply circuit can be reduced in the blank period.

Embodiment 4

The previously explained embodiment 3 relates to the power reduction of the driving circuits employed in the liquid crystal display device. In addition thereto, an embodiment 4 of the present invention is directed to such a feature capable of avoiding destruction and deteriorations as to the data line driving circuit 3.

Figure 9A:
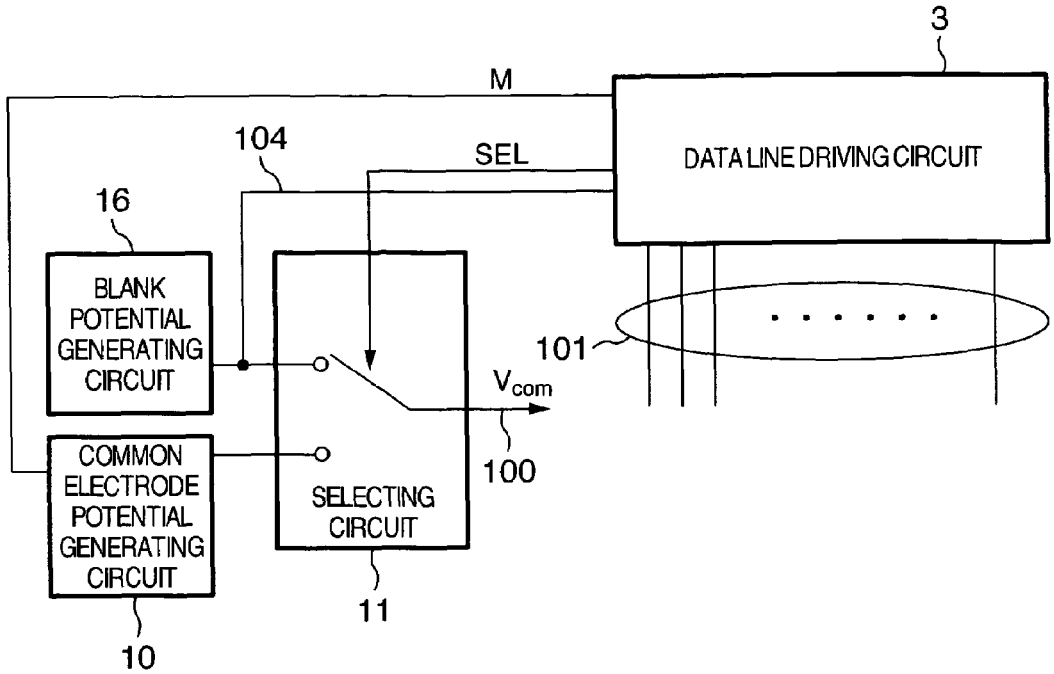
FIG. 9A and FIG. 9B are diagrams for schematically showing a portion of a liquid crystal display device according to an embodiment 4 of the present invention.
Figure 9B:
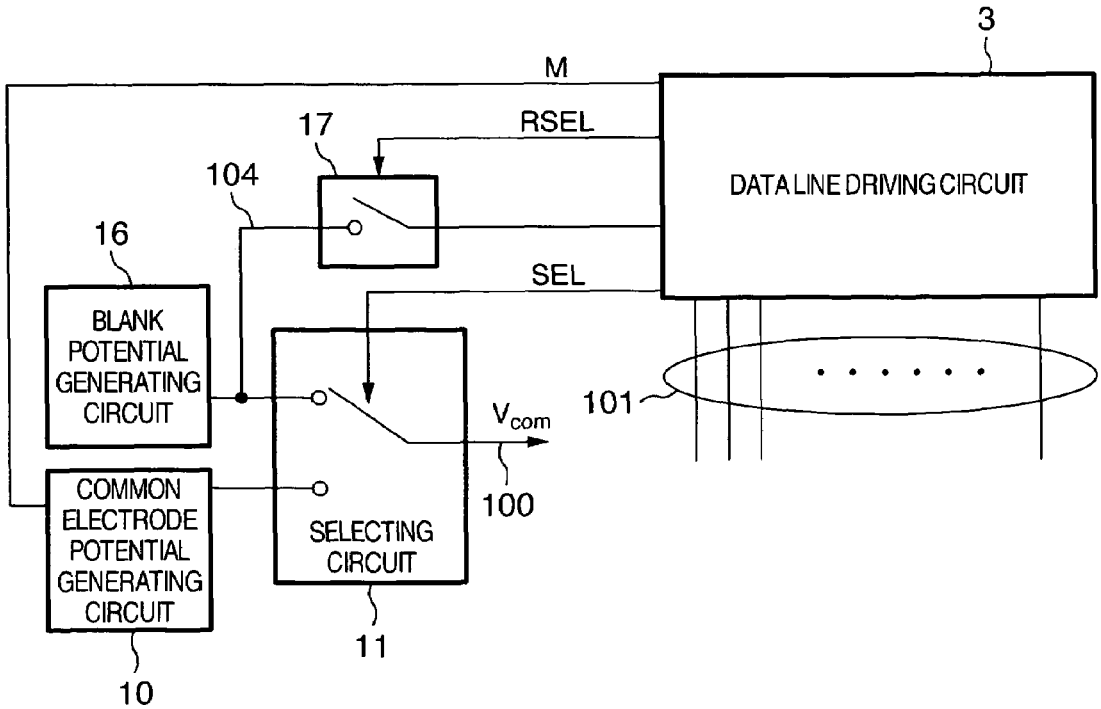
Figure 10A:
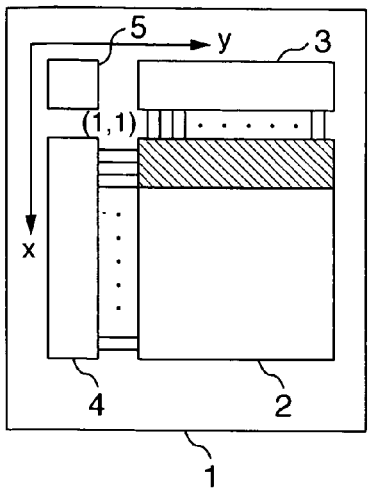
FIG. 10A to FIG. 10E show conceptional diagrams as to liquid crystal display devices which perform partial display operations.
Figure 10B:
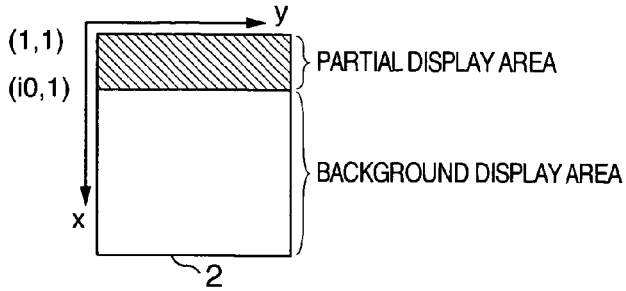
Figure 10C:
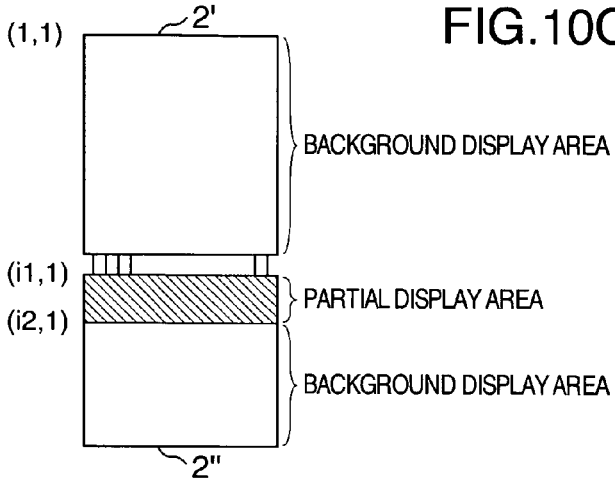
Figure 10D:
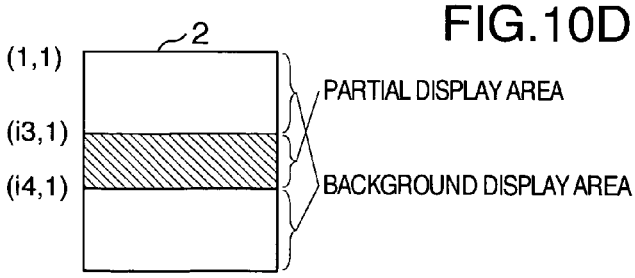
Figure 10E:
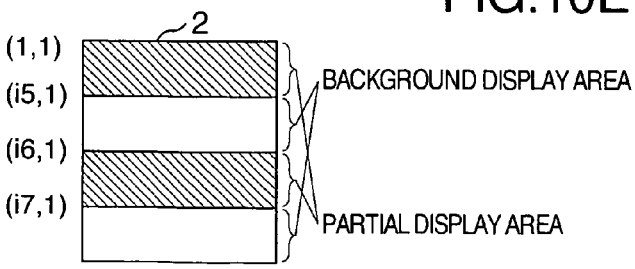
Figure 11A:
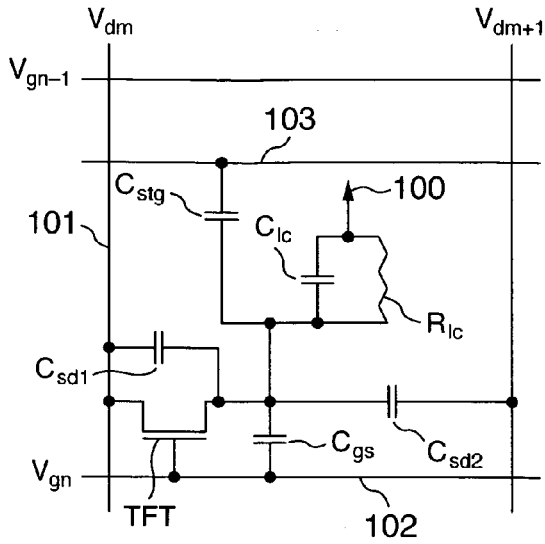
FIG. 11A and FIG. 11B are an equivalent circuit diagram and a timing chart as to a pixel, which are provided so as to explain the driving method in the case that the normal display operation is carried out.
Figure 11B:
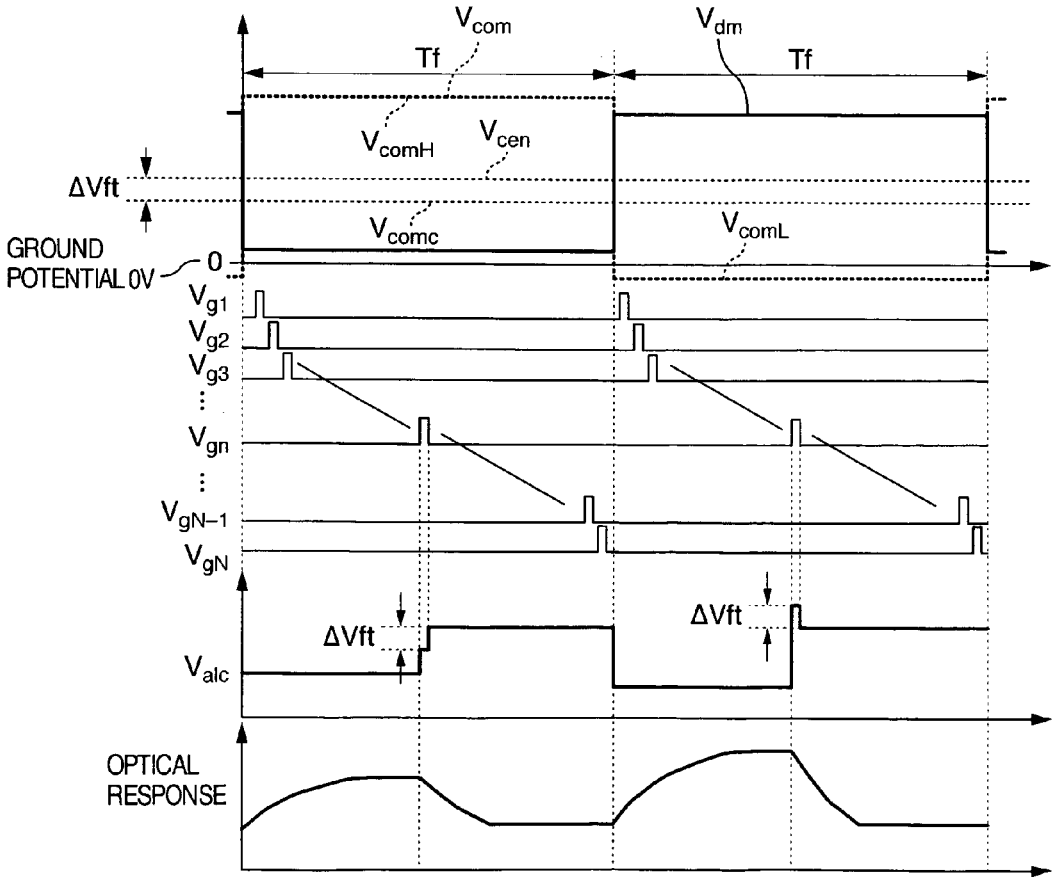
Figure 12:
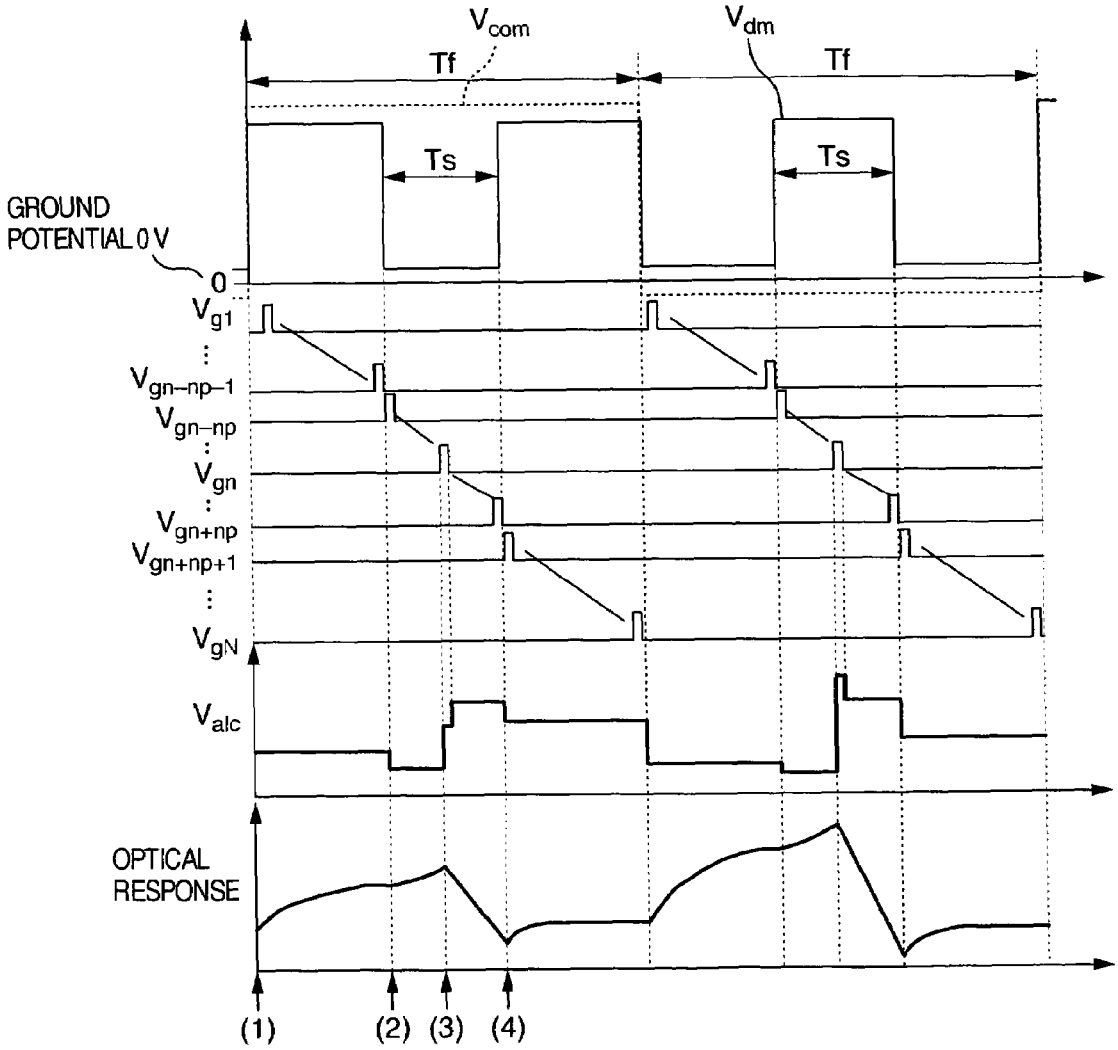
FIG. 12 is a timing chart for explaining the driving method in the case that the partial display operation is carried out.

When the driving methods explained in the embodiments 1 and 2 are carried out, while the time period is transferred from the partially scanning period to the blank period in the partial display mode, there are some risks that the data line driving circuit 3 is destroyed. Referring now to FIG. 9A and FIG. 9B, a problem and a solving method will be explained in a concrete manner. FIG. 9A and FIG. 9B are block diagrams which are arranged by the data line driving circuit 3, a common electrode potential generating circuit, a selecting circuit 11, and a standby potential generating circuit 16. In such a case that the ground potential is employed as this standby potential, this standby potential generating circuit 16 is not present, but implies such a GND terminal for applying the ground potential.

First, an explanation is made of a reason why the data line driving circuit 3 is destroyed with reference to FIG. 9A. The standby potential generating circuit 16 supplies the standby potential to the selecting circuit 11, and the common electrode potential generating circuit 10 supplies either the potential "$V_{comH}$" or the potential "$V_{comL}$" to the selecting circuit 11 in response to the control signal M. The selecting circuit 11 is provided with a switch. This switch selects the entered standby potential and the potential entered from the common electrode potential generating circuit 10 in response to the control signal SEL, and applies the selected potential to the common electrode. A standby potential line 104 for distributing the standby potential outputted from the standby potential generating circuit 16 has been connected to the data line driving circuit 3 and the selecting circuit 11.

Generally speaking, a potential at a line which is connected to a terminal of the data line driving circuit 3 has been formed based upon such an initial condition that this potential is used in a range (will be referred to as "withstanding voltage range" hereinafter) which is defined from the ground potential up to the highest potential in the data line potentials of the partially scanning period.

Since the common electrode potential $V_{comL}$ in the partially scanning period is used so as to correct a feed-through voltage, this common electrode potential $V_{comL}$ becomes lower than, or equal to the ground potential. While the time period is transferred from the partially scanning period to the blank period, if the common electrode 100 which has been charged to the potential $V_{comL}$ is simultaneously shortcircuited to the standby potential line 104, in such a case that a current is insufficiently supplied from the standby potential generating circuit 16 to both the common electrode 100 and the standby potential line 104, then the potential at the standby potential line 104 becomes lower than, or equal to the ground potential. As a result, such a potential other than the withstanding voltage range may be applied to the terminal of the data line driving circuit 3, so that this data line driving circuit 3 may be caused to be destroyed, or deteriorated.

Referring now to FIG. 9B, a description is made of a method of capable of solving this problem. The circuit arrangement of FIG. 9B is nearly equal to that of FIG. 9A. A changed circuit point is explained. That is, in FIG. 9A, both the standby potential generating circuit 16 and the data line driving circuit 3 have been directly connected to the standby potential line 104.

In FIG. 9B, a shortcircuit switch 17 is provided between the data line driving circuit 3 and the standby potential generating circuit 16, while this shortcircuit switch 17 controls conduction and non-conduction. The conduction and the non-conduction of the shortcircuit switch 17 are controlled in response to a control signal RSEL. Only for at least several microseconds before/after the time instant when the time period is transferred from the partially scanning period to the standby period, the shortcircuit switch 17 is opened by the control signal RSEL so as to bring both the data line driving circuit 3 and the standby potential generating circuit 16 into the non-conduction status. During the time period for this non-conduction status, the current may be sufficiently supplied from the standby potential generating circuit 16 to the common electrode 100. As a result, during the time period for the non-conduction status, since the common electrode potential 100 becomes higher than, or equal to the ground potential, even when the shortcircuit switch 17 is brought from the non-conduction status to the conduction status so as to conduct the circuit between the common electrode 100 and the data line driving circuit 3, the potential other than the withstanding voltage range is not applied to the terminal of the data line driving circuit 3. As a consequence, this data line driving circuit 3 is not destroyed, or not deteriorated.

In the embodiments of the present invention, the TFT liquid crystal display in the normally open display mode has been employed, but the present invention is not limited thereto. Alternatively, the present invention may be applied to a TFT liquid crystal display in a normally close mode.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A method of driving an active matrix type liquid crystal display device in which while a partial display mode and a normal display mode are switchable, when the partial display mode is selected, a predetermined display operation is carried out in a partial display area which is constituted by an arbitrarily selected number of gate lines, and a background is displayed on the remaining background display area; wherein:

while the respective gate lines of said partial display area are scanned in a certain period, in such a case that said period is defined as a frame period, "k" pieces (symbol "k" is integer larger than, or equal to 1) of the partial display areas are present within 1 screen, a common electrode potential is varied 2k times within 1 frame period;

a common electrode potential in a partially scanning period for scanning the partial display area is made as a constant potential with respect to a potential which constitutes a reference of a driving circuit for driving the data lines; and within a time period of at least two continued frames, a common electrode potential of a blank period other than the partially scanning period is made as a constant potential which is different from said constant potential in said partially scanning period.

2. A driving method of a liquid crystal display device as claimed in claim 1 wherein:

if a period for scanning 1 row in the normal display mode is defined as "Thn" and a time period for scanning the gate lines in the normal display mode is defined as a frame period, in such a case that a frame frequency "fp" in the partial display mode is lower than a frame frequency "fn" in the normal display mode, said period "Tsh" for scanning one row of the partial display area satisfies a relationship of $Tsh<Thn\times fn/fp$.

3. A driving method of a liquid crystal display device as claimed in claim 2 wherein:

both the common electrode potential and a data line potential during said blank period are set to the ground potential.

4. A driving method of a liquid crystal display device as claimed in claim 1 wherein:

in said blank period, a potential of the data line is set to a constant potential.

5. A driving method of a liquid crystal display device as claimed in claim 4 wherein:

in the case that an absolute value of a difference as to a center potential between a maximum potential and a minimum potential of the data line, and another center potential between a maximum potential and a minimum potential of the common electrode is assumed as "ΔVft", when the display mode of the liquid crystal display device is a normally close, the background display area is displayed in a substantially black color, whereas when the display mode of the liquid crystal display device is a normally open, the background display area is displayed in a substantially white color; and in a time period during which a pixel of the background display area is scanned, the data line potential is set to such a potential which is higher than the common electrode potential only by substantially ΔVft.

6. A driving method of a liquid crystal display device as claimed in claim 4 wherein:

in said blank period, the data line potential is made substantially equal to the common electrode potential.

7. A driving method of a liquid crystal display device as claimed in claim 6 wherein:

the common electrode potential in said blank period is set to a constant potential lower than, or equal to the highest potential in the data line potentials of the partially scanning period, and set to a constant potential higher than, or equal to the ground potential.

8. A driving method of a liquid crystal display device as claimed in claim 6 wherein:

it is so assumed that when the display mode of the liquid crystal display device is a normally close, the background display area is displayed in a substantially black color, whereas when the display mode of the liquid crystal display device is a normally open, the background display area is displayed in a substantially white color;

in such a case that said blank period is longer than said partially display period, the scanning operation of the background display area is not carried out until the display content is changed except for a time period during which the display mode is transferred from the normal display mode to the partial display mode, or except for several frames after the display content has been changed.

9. A driving method of a liquid crystal display device as claimed in claim 7 wherein:

the common electrode potential during said blank period is set to the ground potential.

10. A driving method of a liquid crystal display device as claimed in claim 9 wherein:

in said blank period, the gate line potential of said partial display area is set to be lower than the ground potential by a value which is larger than, or equal to an absolute value of a potential difference between said common electrode potential and the ground potential in the partially scanning period of the negative frame.

11. A method of driving an active matrix type liquid crystal display device in which while a partial display mode and a normal display mode are switchable, when the partial display mode is selected, a predetermined display operation is carried out in a partial display area which is constituted by an arbitrarily selected number of gate lines, and a background is displayed on the remaining background display area; wherein:

while the respective gate lines of said partial display area are scanned in a certain period, in such a case that said period is defined as a frame period; within a period for at least two continued frames, such a time period for scanning the partial display area is defined as a partially scanning period; and a period other than the partially scanning period within said two frame periods is defined as a blank period, a potential of a common electrode is varied only when a period is switched from the partially scanning period to the blank period, and only when a period is switched from the blank period to the partially scanning period.

12. A driving method of a liquid crystal display device as claimed in claim 11 wherein:

while a period for scanning 1 row of the partial display area is defined as "Tsh", in such a case that a partial display area 1 where pixels connected to gate lines from an n1-th row up to an n2-th row perform display operations, and a partial display area 2 where pixels connected to gate lines from an n3-th row up to an n4-th row perform display operations are present (symbols n1, n2, n3, n4 are positive integers, and relationship is given as $n1<n2$, $n2+1<n3<n4$), a length "Tb1" of such a time period that after scanning of the gate line of the n2-th row is commenced, until scanning of the gate line of the n3-th row is commenced satisfies $Tb1<Tsh(n3-n2-1)$.

13. A driving method of a liquid crystal display device as claimed in claim 11 wherein:

a data line potential is varied only in said partially scanning period.

14. A driving method of a liquid crystal display device as claimed in claim 13 wherein:

in said blank period, the data line potential is made substantially equal to the common electrode potential.

15. A driving method of a liquid crystal display device as claimed in claim 13 wherein:

within at least two continued frames, three constant potentials which can be taken as data line potentials are provided in maximum; and two constant potentials among said three constant potentials are defined as potentials employed in the partially scanning period.

16. A driving method of a liquid crystal display device as claimed in claim 14 wherein:

in said blank period, the common electrode potential is set to the ground potential which corresponds to such a potential constituting a reference of a driving circuit for driving the data lines.

17. An active matrix type liquid crystal display device in which while a partial display mode and a normal display mode are switchable, when the partial display mode is selected, a predetermined display operation is carried out in a partial display area which is constituted by an arbitrarily selected number of gate lines, and a background is displayed on the remaining background display area; wherein:

while the respective gate lines of said partial display area are scanned in a certain period, in such a case that said period is defined as a frame period, "k" pieces (symbol "k" is integer larger than, or equal to 1) of the partial display areas are present within 1 screen, a common electrode potential is varied 2k times within 1 frame period;

a common electrode potential in a partially scanning period for scanning the partial display area is made as a constant potential with respect to a potential which constitutes a reference of a driving circuit for driving the data lines; and within a time period of at least two continued frames, a common electrode potential of a blank period other than the partially scanning period is made as a constant potential which is different from said constant potential in said partially scanning period.

18. A liquid crystal display device as claimed in claim 17 wherein:

said liquid crystal display device is comprised of:

a common electrode potential generating circuit for generating a common electrode potential both in the normal display mode and in the partially scanning period;

a selecting circuit into which both the common electrode potential outputted from said common electrode potential generating circuit and a standby potential different from said common electrode potential are inputted, and which selects one of said inputted potentials to output the selected potential to the common electrode; and a control circuit operated in such a manner that while a selection signal for controlling said selecting circuit is present and said selection signal owns two states, said selecting circuit selects the common electrode potential outputted from said common electrode potential generating circuit for such a time period during which said selection signal is under a first state, and selects the standby potential for a time period during which said selection signal is under a second state, said control circuit brings said selection signal into the first state when the normal display mode is selected, and said control circuit brings said selection signal into the first state for the partially scanning period and into the second state for the blank period when the partial display mode is selected.

19. A liquid crystal display device as claimed in claim 18 wherein:

said liquid crystal display device is comprised of:

a driving apparatus operated in such a manner that said standby potential is applied to a data line driving circuit in the case that said standby potential is lower than, or equal to the highest potential of the data line potentials for the partially scanning period and is higher than, or equal to the ground potential; said driving apparatus causes a circuit between the data line and the common electrode to become non-conductive for a time period during which said selection signal is under said first state, and makes the data line potential substantially equal to the common electrode potential for a time period during which said selection signal is under said second state.

20. A liquid crystal display device as claimed in claim 18 wherein:

said liquid crystal display device is comprised of:

a driving apparatus operated in such a manner that as to the two inputs of said selecting circuit, while said standby potential is set to the ground potential, said driving apparatus causes a circuit between the data line and the common electrode to become non-conductive for a time period during which said selection signal is under said first state, and sets the data line potential to the ground potential for a time period during which said selection signal is under said second state.

21. A liquid crystal display device as claimed in claim 18 wherein:

said liquid crystal display device is comprised of:

a switch which controls a conduction and a non-conduction between a line for applying said standby potential which is set to be such a potential lower than, or equal to the highest potential of the data line potentials for the partially scanning period and is higher than, or equal to the ground potential, and a data line driving circuit; and wherein:

in the case that the conduction and the non-conduction of said switch are carried out by a control signal RSEL, when the time period is transferred from the partially scanning period to the blank period, said switch is brought into the non-conduction state by said control signal RSEL during at least several microseconds before/after said time period transition in order that the circuit between said data line driving circuit and the line for applying said standby potential is brought into the non-conduction state.

22. A liquid crystal display device as claimed in claim 18 wherein:

said control circuit stops operation of said common electrode potential generating circuit so as to reduce electric power thereof for a time period during which said selection signal is under the second state, or controls that the electric power of said common electrode potential generating circuit for said time period becomes smaller than electric power of said common electrode potential generating circuit for a time period during which said selection signal is under the first state.

23. A liquid crystal display device as claimed in claim 19 wherein:

said control circuit stops operation of an analog circuit of said data line driving circuit so as to reduce electric power thereof for a time period during which said selection signal is under the second state, or controls that the electric power of said data line driving circuit for said time period becomes smaller than electric power of said data line driving circuit for a time period during which said selection signal is under the first state.

24. A liquid crystal display device as claimed in claim 20 wherein:

a boosting circuit for producing a power supply voltage of the driving apparatus is constructed as a charge pump type boosting circuit; and a frequency of a boosting clock which controls timing of boosting operation for a time period during which said selection signal is under said second state is made lower than a frequency of said boosting clock for a time period during which said selection signal is under the first state.

* * * * *